United States Patent [19]

Enoguchi et al.

[11] Patent Number: 5,008,708

[45] Date of Patent: Apr. 16, 1991

[54] MONOCOMPONENT DEVELOPING DEVICE

[75] Inventors: Yuji Enoguchi; Toshiya Natsuhara; Masashi Yamamoto, all of Osaka, Japan

[73] Assignee: Minolta Camera Kabushiki Kaisha, Osaka, Japan

[21] Appl. No.: 468,235

[22] Filed: Jan. 22, 1990

Related U.S. Application Data

[63] Continuation of Ser. No. 225,465, Jul. 28, 1988, Pat. No. 4,907,032.

[30] Foreign Application Priority Data

| | | | |
|---|---|---|---|
| Jul. 31, 1987 | [JP] | Japan | 62-193585 |
| Jul. 31, 1987 | [JP] | Japan | 62-193586 |
| Jul. 31, 1987 | [JP] | Japan | 62-193587 |
| Jul. 31, 1987 | [JP] | Japan | 62-193588 |

[51] Int. Cl.[5] ..... G03G 15/06

[52] U.S. Cl. ..... 355/259; 118/653; 118/657; 355/251

[58] Field of Search ..... 355/259, 251, 253; 118/657, 658, 653, 656; 430/122

[56] References Cited

U.S. PATENT DOCUMENTS

| | | | |
|---|---|---|---|
| 3,754,526 | 8/1973 | Caudill | 355/253 X |
| 4,207,101 | 6/1980 | Vola et al. | 430/126 |
| 4,537,491 | 8/1985 | Komada et al. | 355/253 |
| 4,641,946 | 2/1987 | Forbes, II | 355/251 |
| 4,775,874 | 10/1988 | Büyükgüclü | 355/253 |
| 4,791,882 | 12/1988 | Enoguchi et al. | 355/259 X |
| 4,806,971 | 2/1989 | Masham | 355/251 |

OTHER PUBLICATIONS

Xerox Disclosure Journal (vol. 11, No. 5) "Hoop" Design Complaint Roll.

*Primary Examiner*—A. T. Grimley
*Assistant Examiner*—Thu Anh Dang
*Attorney, Agent, or Firm*—Burns, Doane, Swecker & Mathis

[57] ABSTRACT

A developing device adjoins a rotatably arranged a photoreceptor, and is internally provided with a rotatably disposed developing roller confronting the photoreceptor, a cylindrically formed flexible film member having a peripheral length longer than that of the developing roller and loosely mounted thereover, a first member for forming a slack of the film member, for example, a regulating blade or a cleaning blade, a second member for controlling the position of the slack of the film member, for example, a magnet.

13 Claims, 19 Drawing Sheets

MONOCOMPONENT DEVELOPING DEVICE

BACKGROUND OF THE INVENTION

Field of the Invention

The present invention generally relates to a developing device for use in an electrophotographic copying machine, a printer or the like and more particularly, to a developing device which uses monocomponent developer, and is capable of easily moving a developing means in and out of contact with a photoreceptor.

Description of the prior Art

Conventionally, Japanese Patent Laid-open Application No. 52-143831 discloses one of such monocomponent developing device, in which upon supply of the non-magnetic toner onto the surface of an elastic developing roller, a blade is pressed against the developing roller so that a thin layer of charged toner may be formed on the peripheral surface thereof and a toner image is, then, formed by bringing the thin layer of the charged toner into direct contact with the surface of the photoreceptor.

Meanwhile, Japanese patent Laid-open Application No. 55-77764 discloses another monocomponent developing device, in which an electrically conductive thin film is arranged on the surface of a developing roller consisting of an electrically conductive soft elastic foamed member. In this developing device, the toner is caused to adhere electrically to the surface of the developing roller with the use of a magnetic brush. And this toner is caused to adhere to an electrostatic latent image through the contact between the developing roller and the surface of the photoreceptor to form the toner image.

However, even in both of these methods, the formation of thin layer of the charged toner necessitates keeping the blade in contact with the surface of the developing roller under a certain pressure greater than a predetermined one. Therefore, the developing roller is required to be relatively high in hardness. On the contrary, to prevent the photoreceptor from being damaged or the image from being smeared on a contact portion between the developing roller and the photoreceptor, the developing roller is required to very softly contact with the photoreceptor. But a developing roller which may satisfy both of these requisites cannot be obtained since these two requisites are completely opposed. Furthermore, in particular, in the case where a peripheral speed of the developing roller is to be differentiated from that of the photoreceptor, the image formed on the photoreceptor tends to be disadvantageously spoiled.

On the other hand, recently, the monocomponent developing devices with the above-mentioned method for developing through contact with the photoreceptor are used for the development of exchanging the color of an image. In this development, when two developing devices simultaneously contact with a photoreceptor, there arises the problem that the developer of one developing device intrudes into the developer of another developing device.

For resolving this problem, Japanese Patent Laid-open Application Nos. 62-15574 and 62-15575 conventionally disclose methods, in which only the necessary developing device for development is caused to contact with a photoreceptor following the displacement of another unnecessary developing device.

Meanwhile, even in the case of a single color development using a single developing device, the developing device must be taken out in a direction of the axis of a photoreceptor for the purpose of exchanging the developing device to change the color of an image and the maintenance of an apparatus. For this reason, a developing device is required to be once moved away from the photoreceptor in order to release the contact between a developing roller and a photoreceptor.

However, in order to release the contact between a photoreceptor and a developing roller in conventional developing devices, the whole developing device was required to be moved away from the photoreceptor. There arises the problem that the construction of an apparatus becomes quite complicated.

SUMMARY OF THE INVENTION

The main object of the present invention is to provide a monocomponent developing device, in which the contact or the non-contact between a developing roller and a photoreceptor can be controlled without moving the whole device.

Another object of the present invention is to provide a monocomponent developing device, which facilitates the exchange of a developing device without causing mixing of colors of toners for making multi-colored development.

Still another object of the present invention is to provide a monocomponent developing device, which facilitates the exchange of the toner color and the maintenance of an apparatus which makes single-colored development.

These and other objects of the present invention can be achieved by providing a monocomponent developing device, which comprises a rotatably disposed developing roller confronting a photorecepter, a cylindrically formed flexible film member having a peripheral length longer than that of said developing roller and loosely mounted thereover, and positioning means to position said flexible film member partly into contact with and out of contact with said photoreceptor, said positioning means including means to form a first slack of the flexible film member at a location confronting said photoreceptor for the flexible film member to contact with the photoreceptor while the remaining portion of the flexible film member is in contact with the developing roller and to form a second slack of the flexible film member at a location remote from the location confronting said photoreceptor for the flexible member to be out of contact with the photoreceptor.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

FIG. 2(*b*) is a side view of a driving source of a magnet arranged in the developing roller of the first embodiment.

FIGS. 7(*c*) and (*d*) are perspective views of a driving system in a pressure roller of said developing device.

FIG. 11(*b*) is a side view showing the position of said guide member in the developing device during the development.

FIG. 12(*b*) is a side view showing the position of the guide member in the developing device during the undevelopment.

FIG. 17(*b*) is a side view showing the position of said guide member in the developing device during the development.

FIG. 18(*b*) is a side view denoting the position of the guide member in the developing device during the undevelopment.

DETAILED DESCRIPTION OF THE PREFERRED EMBODIMENTS

Figure 1A:
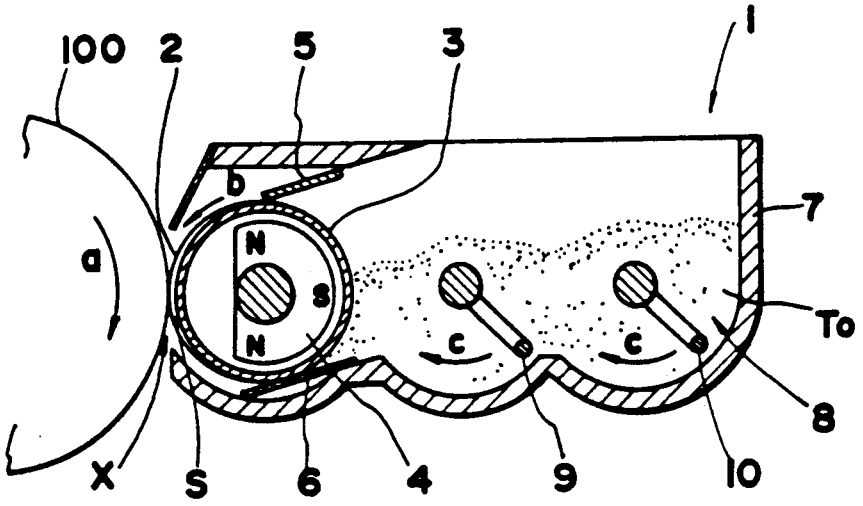
FIGS. 1(*a*) and (*b*) are cross-sectional views of a developing device as one example of a first embodiment of the present invention.
Figure 1B:
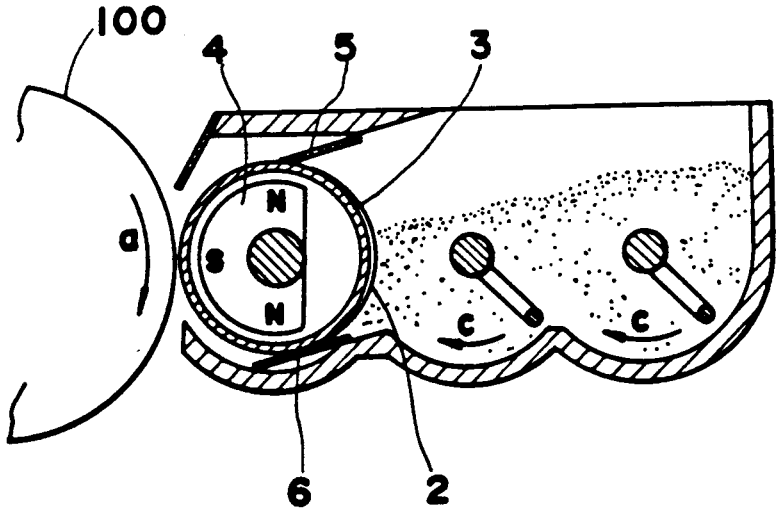

FIG. 1 is a cross-sectional view of a developing device 1 according to a first embodiment of the present invention. The developing device 1 adjoins a photoreceptor drum 100 rotatably driven in a direction as shown by an arrow (a). The developing device 1 comprises a rotatably arranged developing roller 3, a film member 2 consisting of a cylindrical electroformed nickel film (the film thickness: 40 μm) is loosely mounted around the developing roller 3, a substantially semicircular magnet 4 arranged inside of said developing roller 3, a regulating blade 5 pressing against the external surface of said film member 2 for charging a toner and preventing the film member slacking, a cleaning blade 6 for levelling off a residual toner after developing at the down stream side from a region where the development is carried out with respect to the direction of the rotation of the developing roller, and a casing 7 accomodating these components as well as toners. A toner storing compartment 8 is provided into the casing 7. Said toner storing compartment 8 has agitators 9 and 10 respectively rotating in a direction as shown by an arrow (c) in order to transport the toner to a direction as shown by the arrow (c) while preventing the toner from solidifying.

By use of the semicircular magnet 4, the regulating blade 5, and the cleaning blade 6, the film member 2 is attracted to the developing roller 3 at the opposite side to the side confronting the photoreceptor drum 100. More specifically, a slack of the film member is formed on the side confronting the photoreceptor by attraction of the magnet and frictional force exerted between the regulating blade 5 or the cleaning blade 6 and the film member rotating with the developing roller, and this slack of the film member is caused to contact with the photoreceptor by the magnet, the regulating blade and the cleaning blade.

It is to be noted here that the film member 2, the developing roller 3, and the regulating blade 5 and the cleaning blade 6 are selected to satisfy the relationship of $\mu_1 > \mu_2$, wherein the coefficient of the friction between the external surface of the developing roller 3 and the internal surface of the film member 2 is $\mu_1$, and that between the external surface of the film member 2 and the blade 5 or the cleaning blade 6 is $\mu_2$. Consequently, with the rotation of the developing roller 3 in a direction as shown by the arrow (b), the film member 2 is moved in the same direction.

The external surface of the magnet 4 has the semicircular shape in order to fit into the internal surface of the developing roller 3. Said semicircular magnet 4 has a plurality of poles at the external surface thereof. When the developing device is out of operation, this semicircular magnet 4 occupies the position as shown in FIG. 1(*b*) in which the magnet occupies the position confronting the photoreceptor. While when the developing device is in operation, the semiconductor magnet 4 rotates for a half rotation by a driving source (shown in FIGS. 2(*a*) and (*b*)) to occupy the position as shown in FIG. 1(*a*) in which the magnet 4 occupies the position opposite to the position confronting the photoreceptor.

The mechanism of said driving source will be explained using FIGS. 2(*a*) and (*b*).

Figure 2A:
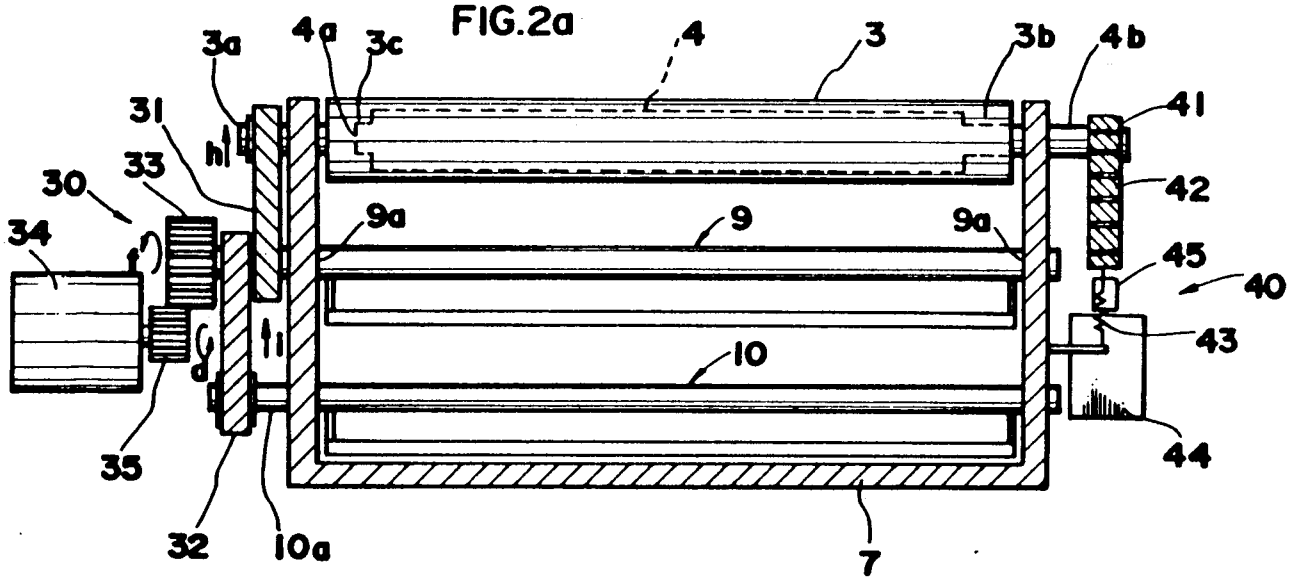
FIG. 2(*a*) is a cross-sectional view of the developing roller and agitators disposed in the developing device of the first embodiment.
Figure 2B:
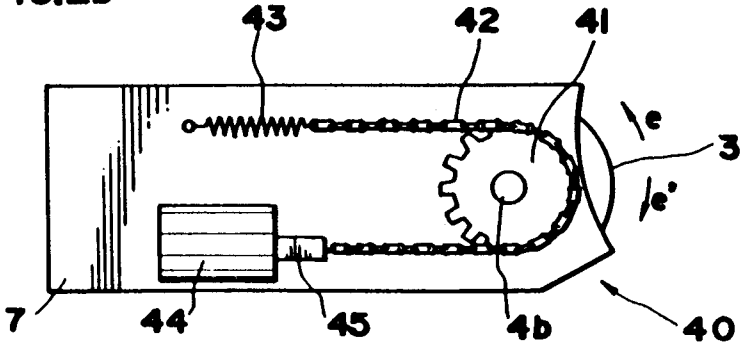

As shown in FIG. 2(*a*), one end 4*a* of a shaft of the magnet 4 is supported by a bearing 3C provided within the developing roller 3 and another end 4*b* of the shaft of the magnet 4 is supported by one side wall of the casing 7. The magnet 4 rotates at a predetermined angle by a moving means 40 mentioned hereinbelow.

Meanwhile, the developing roller 3 has a bearing 3*b* on the right side in FIG. 2(*a*) which is supported by the shaft 4b of the magnet 4 and another support shaft 3a on the opposite side which is supported by another side wall of the casing 7. The developing roller 3 rotates by a driving means 30.

Agitators 9 and 10 have shafts 9a and 10a respectively supported by side walls of the casing 7 for rotatably driven by the driving means 30.

As shown in FIG. 2(*a*), a belt 31 is bridged over on both of the shaft 3a of the developing roller 3 and the shaft 9a of the agitator 9. Similarly a belt 32 is also bridged over on both of the shaft 9a of the agitator 9 and the shaft 10a of the agitator 10.

Moreover, arranged at the end of the shaft 9a of the agitator 9 is a gear 33 which is engaged with a driving gear 35 of a motor 34.

Accordingly in the case where the driving gear 35 is cansed to rotate in a direction as shown by an arrow (d) in FIG. 2(*a*), the gear 33 and the belt 31 and 32 respectively move in directions as shown by the arrows f, h and i and at the same time the developing roller 3 and the agitators 9 and 10 rotate respectively in directions as shown by the arrows (b) and (c).

The moving means 40 of the magnet 4 mentioned above, is composed of a sprocket 41, a chain 42, a spring 43 and a solenoid 44 as shown in FIG. 2(*b*). The sprocket 41 is fixed at the end of the shaft 4b of the magnet 4. One end of the spring 43 fixed in the casing 7 is attached to one end of the chain 42 for consistently urging the chain 42 in a direction as shown by an arrow (e). Further, a plunger 45 of the solenoid 44 is attached to another end of the chain 42 so as to allow the magnet 4 to rotate by the energization of the solenoid 44 in a direction as shown by an arrow (e') against the urging force of the spring 43.

When the solenoid 44 is in operation, the magnet 4 rotates for a half rotation in the direction as shown by the arrow (e') to occupy the position as shown in FIG. 1(*b*) in which the magnet occupies the position confronting the photoreceptor.

On the contrary, when the solenoid 44 is out of operation, the magnet 4 rotates for a half rotation in the direction as shown by the arrow (e) to occupy the position as shown in FIG. 1(*a*).

Comparing the case where the magnet 4 is moved following the stop of the rotation of the developing roller 3 with the case where the magnet 4 is moved using the rotative force of the developing roller 3, the latter case would be best because the slack of the film member is more smoothly formed and the movement of the magnet is more smoothly achieved.

Furthermore, the cleaning blade 6 is provided in pressing the film member so as not to affect the slack portion of the film member.

The developing roller is made of electrically conductive materials such as aluminum in which the surface is made rough by a blast treatment, rubber or plastic materials in which electrical conductivity is given by carbon or the like. A developing bias voltage is applied to the developing roller.

The film member has the peripheral length somewhat longer than that of the developing roller so as to be loosely mounted thereover for forming a little slack. Materials capable of being attracted by the magnetic force can be used to form the film member. Examples of such materials are a film having a thickness of about 30 to 200 μm wherein metallic fine particles or the like are added to the soft resins such as polycarbonate, nylon, Teflon (trademark) or the like, a metallic thin film of nickel, stainless steel or the like having a thickness of 30 to 50 μm, or a laminated film of the aforementioned resinous film and metallic thin film.

Materials having elasticity is preferably used for forming the regulating blade 5. Examples of such materials are a magnetic and metallic thin plate, or a non-magnetic and metallic thin plate such as stainless steel, phosphor bronze or the like, a plastic plate of Teflon (trademark), nylon, or the like, an elastic plate of Teflon (trademark) rubber, silicone rubber or the like, and a laminated plate of the above-mentioned plastic plates. In short, materials conventionally used for forming a toner layer regulating blade can be used for forming the regulating blade 5. The materials which remote from the toner in triboelectric series are desirable for forming the regulating blade 5. In the case where the positive toner is used as a developer, materials which are suitable for forming the regulating blade are a resinous plate of fluorine resin; Teflon (trademark), or the plate coated by the fluorine resin. While in the case where the negative toner is used as a developer, materials which are suitable for forming the regulating blade are a resinous plate of polyamide film; nylon, or the plate coated by the polyamide resin.

It is to be noted here that although monocomponent non-magnetic toner is preferably used in the developing device of this embodiment, magnetic toner may be used therein.

The operation of the developing device 1 of the first embodiment in the present invention during the development will be explained hereinafter.

In FIG. 1(*a*), To shows the toner accommodated within the toner storing compartment 8, X shows a developing region where the film member 2 contacts with the photoreceptor, and S shows a space formed between the developing roller 3 and the film member 2.

On condition that the developing roller 3 and the agitators 9 and 10 are caused to rotate by the driving means 30 respectively in directions as shown by the arrows (b) and (c), the toner To accommodated within the toner storing compartment 8 is forcibly moved in the direction shown by the arrow (c) under an effect of stirring by the agitators 9 and 10.

Meanwhile, the film member 2 is driven to rotate in a direction as shown by the arrow (b) under the influence of frictional force exerting between it and the developing roller 3. The toner To accommodated within the toner storing compartment 8, which is in contact with the film member 2, is caused to adhere to the surface of the film member 2 by the action of electrostatic force so as to be transported in the direction as shown by the arrow (b). The toner To is held on the surface of the film member 2, and when it reaches the portion pressed by the regulating blade 5 on the surface of the developing roller 3, the toner To is applied uniformly in the form of a thin layer to the surface of the film member 2 and given a predetermined positive or negative polarity through the friction therewith.

When the toner To held on the surface of the film member 2 under the influence of its own electrostatic force, reaches a developing region X confronting the photoreceptor drum 100, the toner To is caused to adhere to an electrostatic latent image formed on the surface of the photoreceptor drum 100 to form a toner image in accordance with a voltage difference between a surface voltage of the photoreceptor drum 100 and the bias voltage applied to the developing roller 3.

Since the film member 2 in contact with the photoreceptor drum 100 is never brought into contact with the developing roller due to the existence of a space S, the film member 2 softly and uniformly contacts with the photoreceptor drum 100 through its suitable nip width so that the latent image formed on the photoreceptor drum 100 may be turned to the uniform toner image. It is to be noted here that a peripheral speed of the photoreceptor drum 100 can be caused to differ from that of the film member 2, resulting in that the toner image once formed on the photoreceptor drum 100 can never be broken by physical force such as the rubbing force or the like. In particular, in the case where the peripheral speed of the film member 2 is set faster than that of the photoreceptor drum 100, the density of an image can be increased so that a fog can be effectively prevented in a non-image portion.

The toner To having passed the developing region X is successively transported, together with the film member 2, in a direction as shown by the arrow (b). When the toner To passes between the cleaning blade 6 and the film member 2, an image pattern from which the toner To has already been consumed in the developing region X is erased so that the uniformity of the toner layer may be obtained.

Subsequently, the toner To is supplied again to the surface of the film member 2 by the rotation of agitator 9 and 10, and then, the thin layer of the charged toner is uniformly formed again on the surface of the film member 2 at the pressure portion of the regulating blade 5, and the aforementioned operation is repeated thereafter.

Meanwhile when the developing device is out of operation, the magnet 4 rotates for a half rotation in order to absorb the film member 2 to the developing roller 3 at the side confronting the photoreceptor. As a result, the slack of the film member 2 is formed at the side opposed to the side confronting the photoreceptor so that the control between the film member and the photoreceptor 100.

Figure 3A:
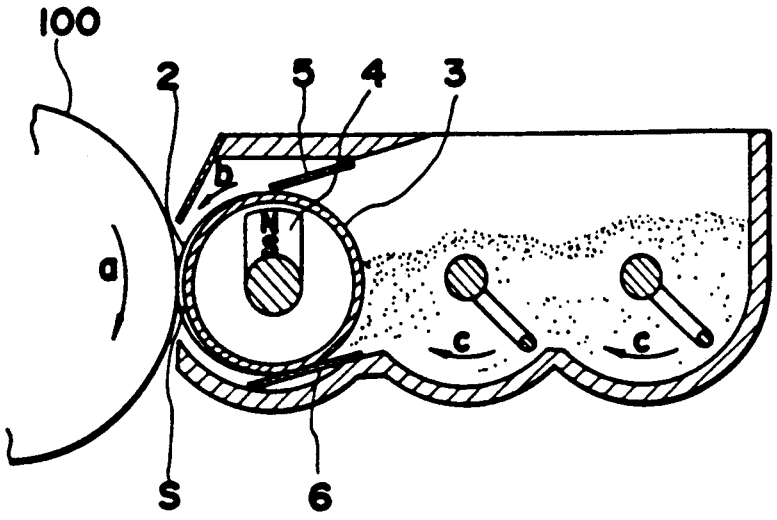
FIGS. 3(*a*) and (*b*) and FIGS. 4(*a*) and (*b*) are cross-sectional views of developing devices as the other examples of the first embodiment.
Figure 3B:
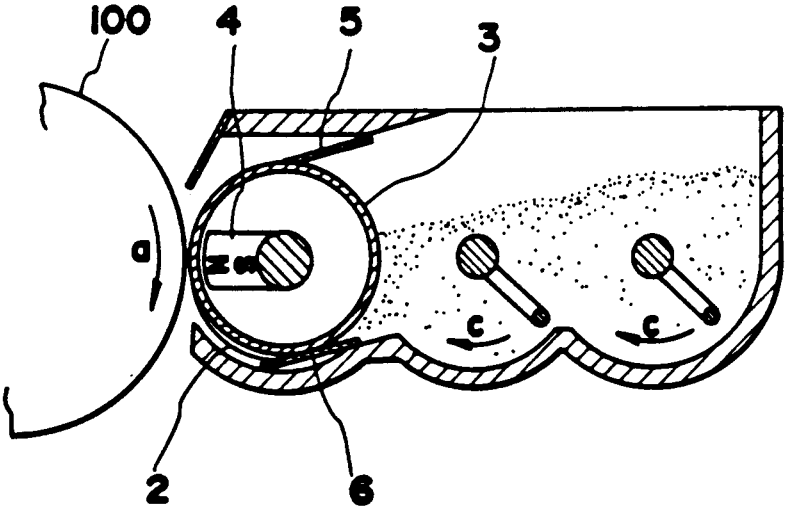

FIG. 3(*a*) which is a cross-sectional view of a developing device as another example of the first embodiment of the present invention shows the condition during the development. In the developing device shown in FIG. 3(*a*), a bar shaped magnet 4 with only one N-S pole within the developing roller 3 faces against the regulating blade 5. Accordingly by use of the regulating blade 5, the cleaning blade 6, and the magnet 4, the film member is attracted to the developing roller 3. It is to be noted here that the developing roller, the film member, the cleaning blade and the regulating blade are selected to satisfy the relationship of $\mu_1 > \mu_2 > \mu_3$, wherein the coefficient of the friction between the external surface of the developing roller and the internal surface of the film member is $\mu_1$, that between the cleaning blade and the external surface of the film member is $\mu_2$, and that between the regulating blade and the external surface of the film member is $\mu_3$. When a thin layer of a toner is formed on the surface of the film member, the coefficient of the friction between the regulating blade and the external surface of the film member changes as well as that between the cleaning blade and the external surface of the film member. However, the relationship among the above-mentioned $\mu_1$, $\mu_2$, and $\mu_3$ remains unchanged. The magnet 4 located below the regulating blade improves the adhesivity between the film member and the developing roller so as to prevent the film member from slacking before passing under the regulating blade. As a result, the film member can always move in a stable condition.

FIG. 3(*b*) shows the developing device of FIG. 3(*a*) in non-contacting condition. The magnet 4 rotates at an angle of 90° in synchronism with the rotation of the developing roller in order to face the photoreceptor. Therefore, the slack of the film member which is in contact with the photoreceptor is absorbed and adhered to the surface of the developing roller in order to release the contact between the photoreceptor and the developing roller, and then, the slack is formed at downstream side from the developing region X with respect to the direction of the rotation of the developing roller.

Figure 4A:
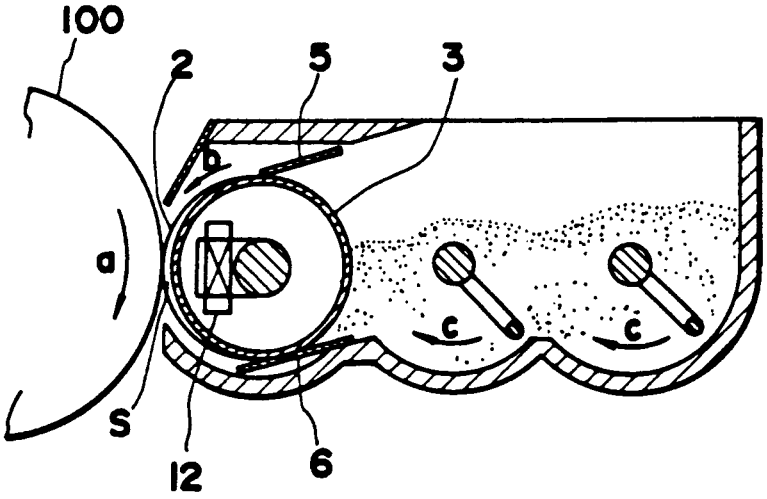
Figure 4B:
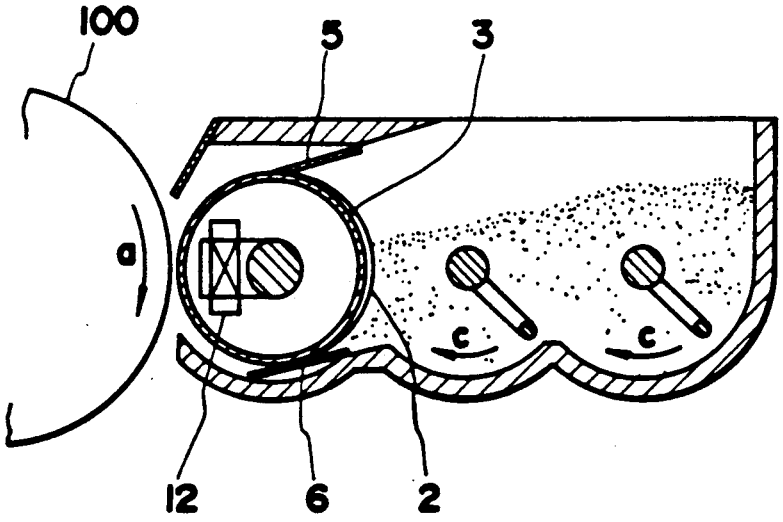

FIG. 4(*a*) is a cross-sectional view of a developing device as still another example of the first embodiment of the present invention. In FIG. 4(*a*), a magnet is an electromagnet 12 confronting a photoreceptor. The film member is caused to adhere by the regulating blade 5 and the cleaning blade 6. It is to be noted here that the developing roller, the cleaning blade, the film member, the regulating blade are selected to satisfy the relationship of $\mu_1 > \mu_2 > \mu_3$, wherein the coefficient of the friction between the external surface of the developing roller and the internal surface of the film member is $\mu_1$, that between the cleaning blade and the external surface of the film member is $\mu_2$, and that between the regulating blade and the external surface of the film member is $\mu_3$. The electromagnet 12 kept being deenergized during the development as shown in FIG. 4(*a*). As a result, the space S is formed between the film member 2 and the developing roller 3 at the side confronting the photoreceptor to maintain the contact between the photoreceptor and the film member.

While, in the case of the non-development, the electromagnet 12 is electrically energized in order to be able to operate. Therefore, as shown in FIG. 4(*b*), the electromagnet 12 absorbs the film member 2 to the developing roller at the side confronting the photoreceptor in order to release the contact between the film member 2 and photoreceptor 100, resulting in that the slack of the film member 2 is formed at the side opposed to the side confronting the photoreceptor.

Figure 5:
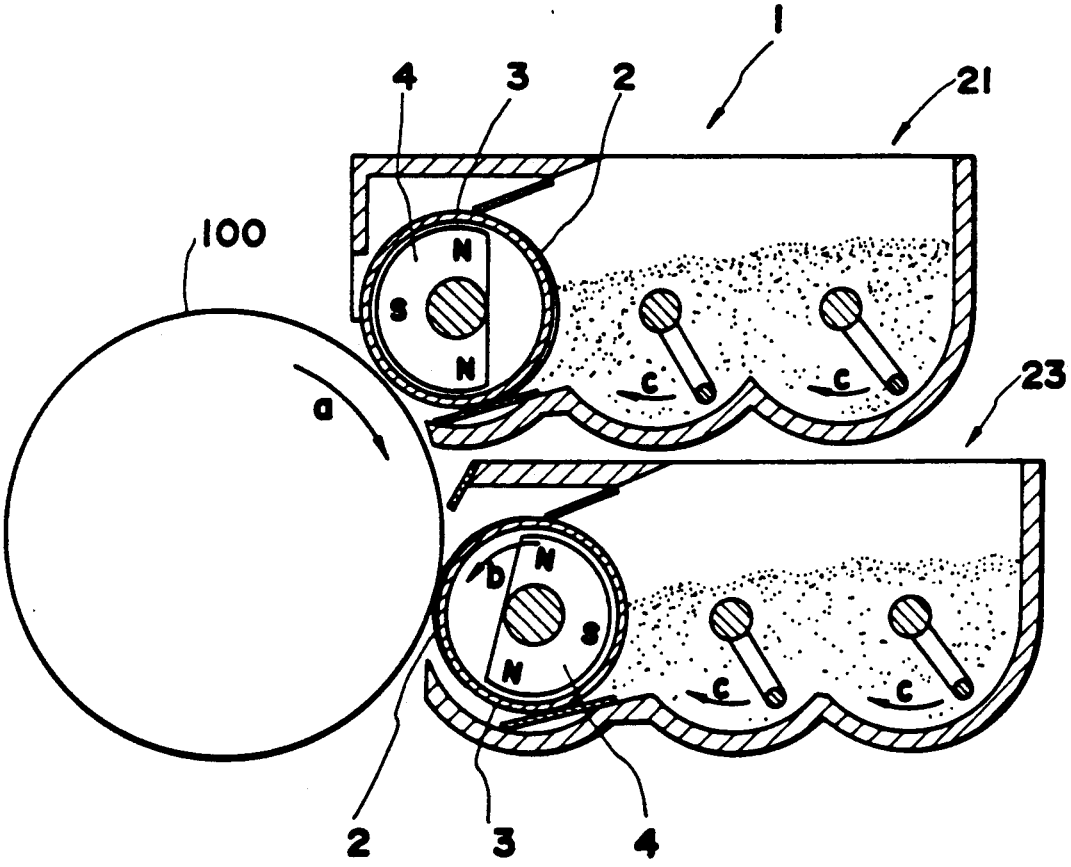
FIG. 5 is a cross-sectional view of two developing devices of the first embodiment disposed around a photoreceptor.

FIG. 5 is a cross-sectional view of two developing devices of the first embodiment of the present invention disposed around the photoreceptor. In a first developing device 21, the magnet 4 faces to the side confronting the photoreceptor so as to absorb the film member 2 to the developing roller 3 by its own attraction, so that the film member 2 releases the contact with the photoreceptor 100. On the other hand, in a second developing device 22, the magnet 4 faces to the opposite side to the side confronting the photoreceptor so as to absorb the film member 2 to the developing roller 3 by its own attraction. As a result, the slack of the film member 2 is formed at the side confronting the photoreceptor of the developing roller in order to bring the film member 2 into contact with the photoreceptor 100, and the development by the developing device 23 is carried out.

Figure 6A:
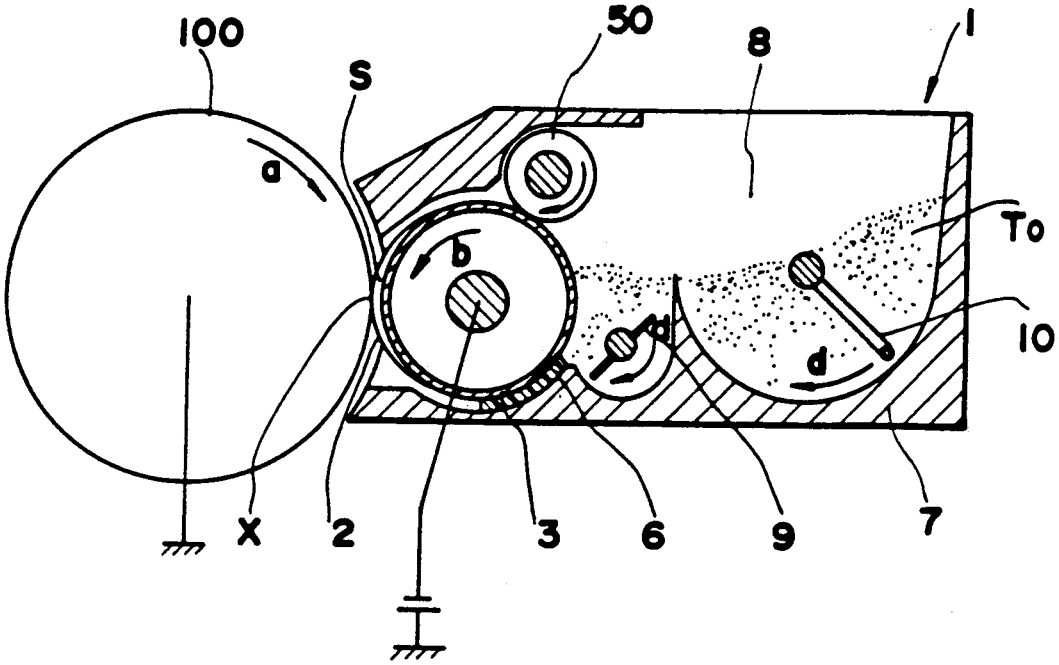
FIGS. 6(*a*) and (*b*) are cross-sectional views of a developing device as one example of a second embodiment of the present invention.
Figure 6B:
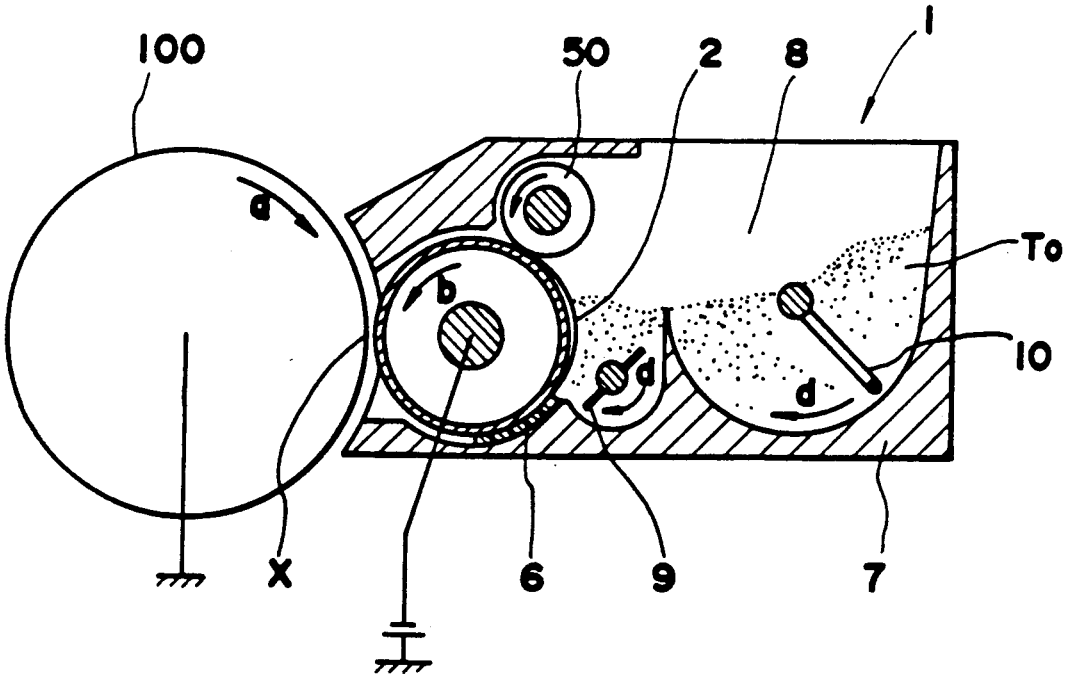
Figure 7A:
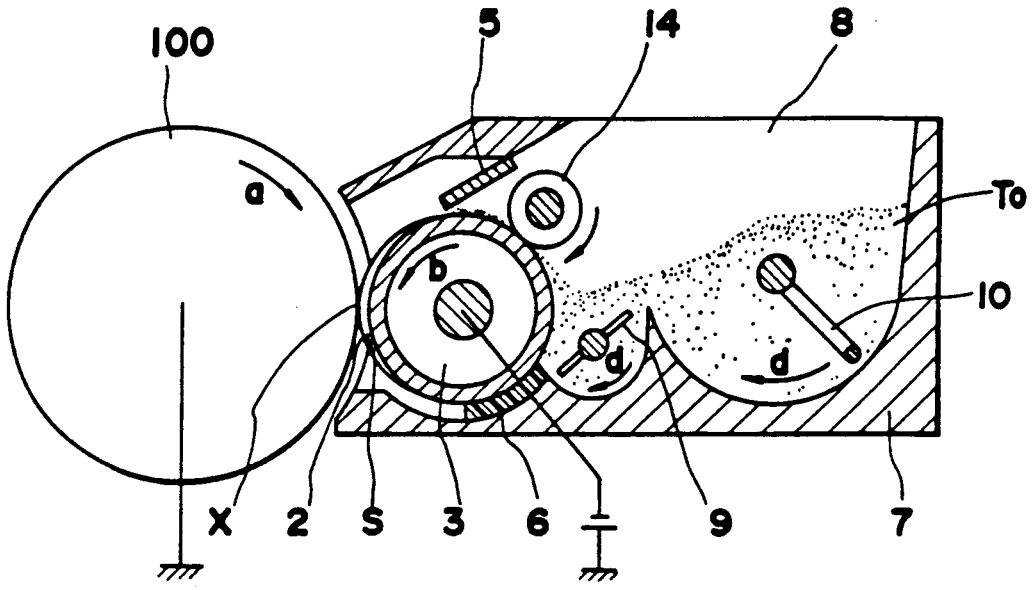
FIGS. 7(*a*) and (*b*) are cross-sectional views of a developing device as another example of the second embodiment.
Figure 7B:
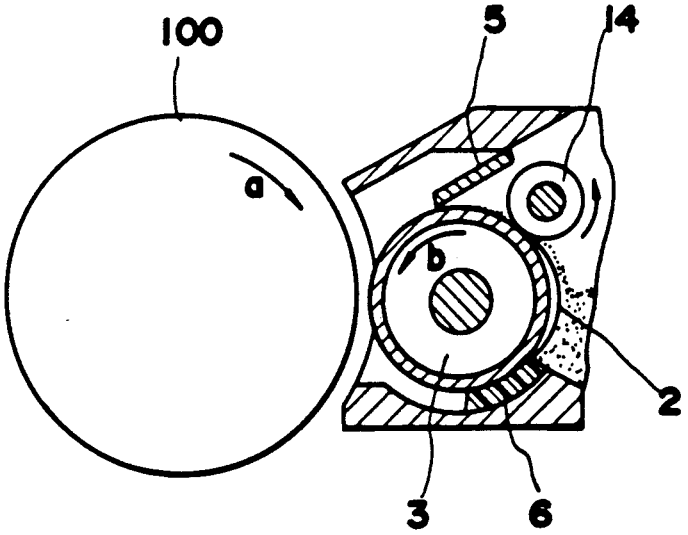
Figure 7C:
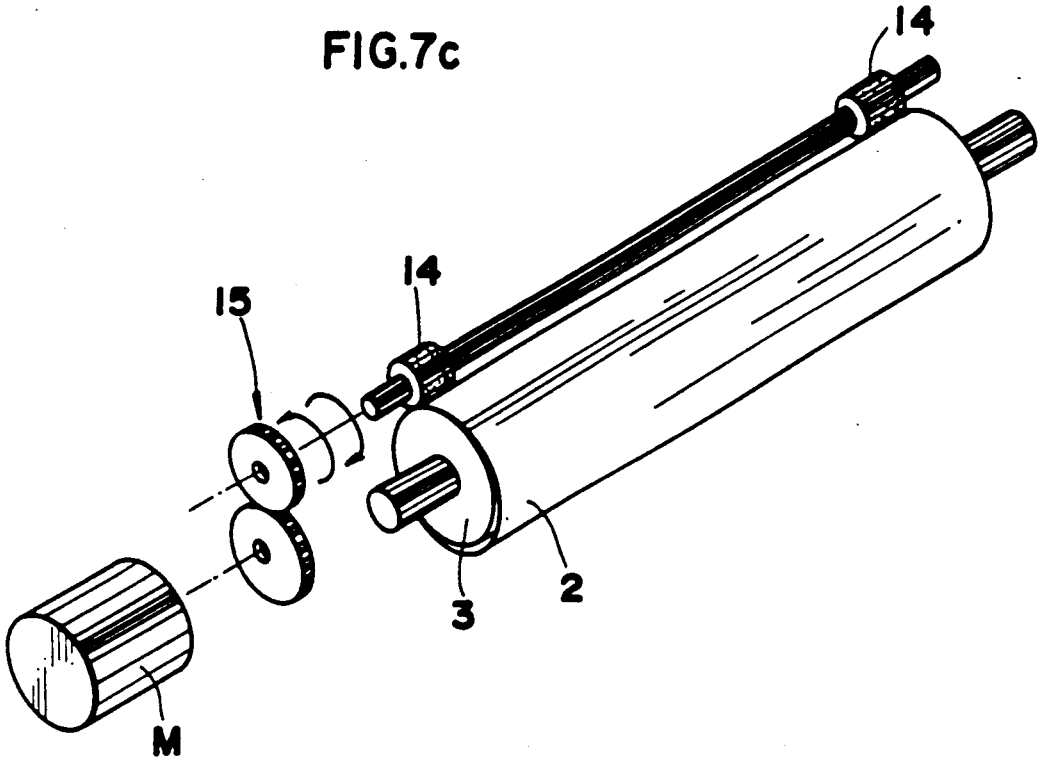
Figure 7D:
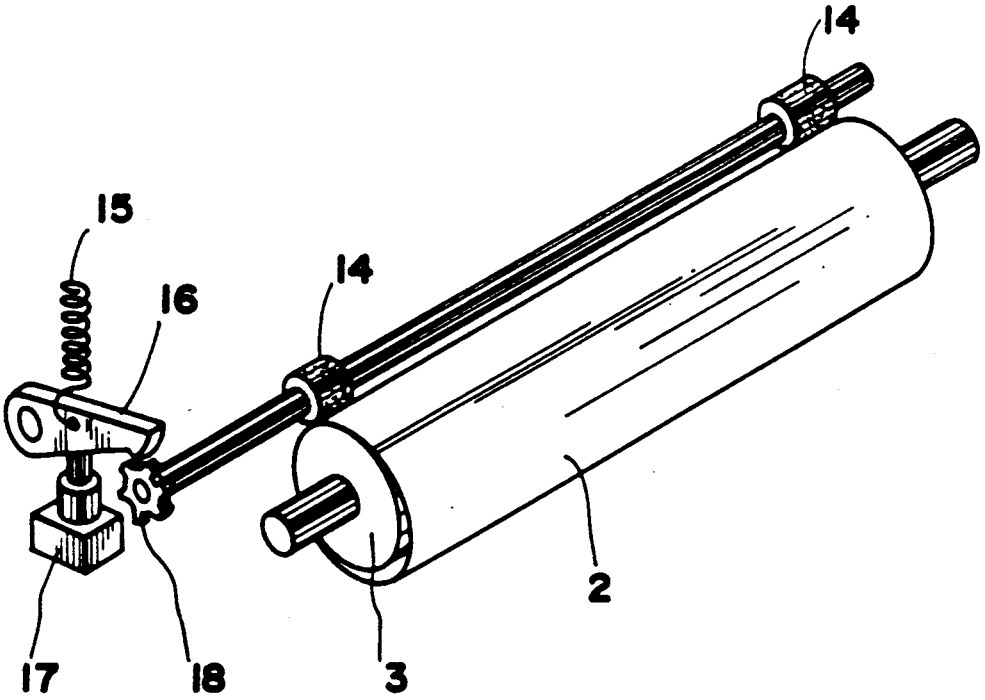

FIG. 6(*a*) is a cross-sectional view of a developing device 1 embodying a second embodiment of the present invention. A roller 50 regulating the thin layer of the toner (hereinafter referred to as a regulating roller 50) is arranged in pressing contact with the developing roller. Said regulating roller presses the film member 2 in order to regulate the rotation of the film member and to charge the toner. The cleaning blade 6 presses contact with the film member 2 as well as the regulating roller 50.

Further, a toner storing compartment 8 accommodates a toner supply blade 9 and an agitator 10 rotating in a direction as shown by the arrow (d). The toner To accommodated within the toner storing compartment 8 is transported forwards while being prevented from solidifying by the toner supply blade and the agitator. Except for the above-mentioned items, the developing device 1 is similar in construction to the one of the first embodiment.

The regulating roller 50 rotates in a direction opposite to the direction as shown by the arrow (b) to transport the film member 2 toward the side confronting the photoreceptor 100. Meanwhile the cleaning blade 6 presses contact with the film member 2, so that the slack of the film member 2 is formed at the developing region X. As a result, the film member 2 contacts with the surface of the photoreceptor.

It is to be noted here that the developing roller 3, the film member 2, the regulating roller 50, and the cleaning blade 6 are selected to satisfy the relationship of $\mu_1 >> \mu_2$, wherein the coefficient of the friction between the external surface of the developing roller 3 and the internal surface of the film member 2 is $\mu_1$, that between the external surface of the film member 2 and the regulating roller 50 or the cleaning blade 6 is $\mu_2$. Therefore, the film member 2 moves in the direction as shown by the arrow (b) with the rotation of the developing roller 3.

The regulating roller 50 consists of an elastic rubber roller, or a roller provided with a laminated layers which includes a resin layer as the upper layer, a foamed urethane layer as the middle layer, and an elastic rubber layer as the lower layer. To effectively give a predetermined polarity to the toner, materials which remote from the toner in the triboelectric series should be selected for forming the surface of the regulating roller 50. Further, in the case where the developing roller 3 has elasticity, a metallic roller of aluminum or the like can be used as the regulating roller 50.

When the developing device 1 is in operation, the regulating roller 50 rotates in a direction opposite to the direction as shown by the arrow (b) as shown in FIG. 6(*a*). On the contrary, when the developing device is out of operation, the regulating roller 50 rotates in the same direction as the developing roller 3 for a predetermined time in order to form the slack of the film member 2 at the side opposite to the side confronting the photoreceptor. In another way, the regulating roller 50 stops rotating in order to form the slack of the film member 2 at the side opposite to the side confronting the photoreceptor.

It is to be noted here that the developing roller of the second embodiment in the present invention is similar in materials to the one of the first embodiment.

Examples of materials used for the film member are soft resinous sheet, for example, polycarbonate, nylon, Teflon (trademark) or the like, a sheet of such resin including carbon or metallic fine particles or the like having a thickness 30 to 200 μm, a metallic thin film of nickel, stainless steel, aluminum or the like having a thickness of 30 to 50 μm, or a laminated sheet of the aforementioned resinous sheet and metallic thin film. In particular, in case of using a resinous sheet of these sheets and films, the resinous sheet remote from the toner in triboelectric series should be used.

When the positive toner is used as a developer, materials which are suitable for forming the film member are fluorine resin; ethylene-tetrafluoroethylene copolymer (ETFE), polytetrafluoroethylene (PTFE) or the like. Meanwhile when the negative toner is used as a developer, materials which are suitable for forming the film member are polyamide resin; nylon or the like.

It is to be noted here that both of magnetic and non-magnetic toners can be used as monocomponent toner in the developing device of this embodiment.

The operation of the developing device of this embodiment will be explained hereinafter.

During the development, as shown in FIG. 6 (*a*), on condition that the developing roller 3, the toner supply blade 9 and the agitator 10 are caused to rotate by the driving means 30 shown in FIG. 2 (*a*) respectively in directions as shown by the arrows (b) and (d), the toner To accommodated within the toner storing compartment 8 is forcibly moved in the direction shown by the arrow (d) under an effect of stirring by the toner supply blade 9 and the agitator 10.

Meanwhile, the film member 2 is driven to rotate in the direction as shown by the arrow (b) under the influence of frictional force exerting between it and the developing roller 3.

The toner To accommodated within the toner storing compartment 8, which is in contact with the film member 2, is caused to adhere to the surface of the film member 2 by the action of electrostatic force to be transported in the direction as shown by the arrow (b). And then, the toner To held on the surface of the film member 2 reaches the portion pressed by the regulating roller 50 on the surface of the developing roller 3. Said regulating roller 50 rotates while contacting with the developing roller 3 in a direction opposite to the direction as shown by the arrow (b) with a faster or slower speed than the film member 2 driven by the developing roller 3, so that the toner To is applied uniformly in the form of a thin layer on the surface of the film member 2 and is changed through the friction therewith.

The toner To held on the surface of the film member 2 under the influence of its own electrostatic force, forms a toner image to be developed through the similar process to the first embodiment.

Since the film member 2 in contact with the photoreceptor drum 100 is never brought into contact with the developing roller due to the existence of the space S, the film member 2 softly and uniformly contacts with the photoreceptor drum 100 through its suitable nip width so that the latent image formed on the photoreceptor drum 100 may be turned to the uniform toner image.

It is to be noted here that a peripheral speed of the photoreceptor drum 100 can be caused to differ from that of the film member 2, resulting in that the toner image once formed on the photoreceptor drum 100 can never be broken by physical force such as rubbing force or the like. In particular, in the case where the peripheral speed of the film member 2 is set faster than that of the photoreceptor drum 100, the density of an image can be increased, so that a fog can be effectively prevented in a non-image portion.

The toner To having passed the developing region X is successively transported, together with the film member 2 in a direction as shown by the arrow (b). When the toner To passes between the cleaning blade 6 and the film member 2, an image pattern from which the toner To has already been consumed in the developing region X is erased so that the uniformity of the the toner layer may be obtained.

Subsequently, the toner is supplied again to the surface of the film member 2 by the rotation of the toner supply blade 9, the thin layer of the charged toner is uniformly formed again on the surface of the film member 2 at the pressure portion of the regulating roller 50, and the aforementioned operation is repeated thereafter.

On the other hand, when the developing device 1 does not operate, as shown in FIG. 6 (b), a clutch of the driving system (not shown) for the regulating roller 50 is switched so as to cause to rotate the regulating roller 50 in the direction as shown by the arrow (b). In another way, the rotation of the regulating roller 50 is caused to stop, moreover, the developing roller is deenergized after a predetermined time has passed.

By either of these two ways to rewind the film member 2, the slack of the film member 2 can be formed at the opposite side to the developing region X of the developing roller in order to release the contact between the photoreceptor 100 and the film member 2.

FIG. 7 is a cross-sectional view of a developing device as another example of the second embodiment of the present invention. In the developing device as shown in FIG. 7 (*a*), a pressing roller 14, the regulating blade 5, and the cleaning blade 6 respectively press contact with the film member 2. Therefore, as shown in FIGS. 7(*b*) and (*c*), when the developing device stops its developing operation, the pressing roller 14 rotates in the direction as shown by the arrow (b) by switching a clutch 15 as the case of the above-mentioned FIG. 6 on purpose to form the slack of the film member at the opposite side to the side confronting the photoreceptor, so that the film member 2 releases the contact with the photoreceptor.

As another example of the second embodiment, the developing operation may be discontinued by terminating the rotation of the pressing roller 14 by engaging a stopper 16 with a clutch gear 18 through the activation a solenoid 17 as shown in FIG. 7 (*d*). It is to be noted here that said stopper 16 is pulled up by a spring 15 in order not to contact with said clutch gear 18 during the development. Furthermore, the film member 2, the developing roller 3, the cleaning blade 6, the regulating blade 5, and the pressing roller 14 are selected to satisfy the relationship of $\mu_1 > \mu_4 > \mu_2 > \mu_3$, wherein the coefficient of the friction between the internal surface of the film member 2 and the external surface of the developing roller 3 is $\mu_1$, that between the external surface of the film member 2 and the cleaning blade 6 or the regulating blade 5 or the pressing roller 14 being at a standstill are respectively $\mu_2$, $\mu_3$, and $\mu_4$. Consequently, when the pressing roller 14 stops, the slack of the film member moves from the side confronting photoreceptor to the opposite side in synchronism with the rotation of the developing roller 3, so that the contact between the film member and the photoreceptor is released as shown in FIG. 7 (*b*).

Figure 8A:
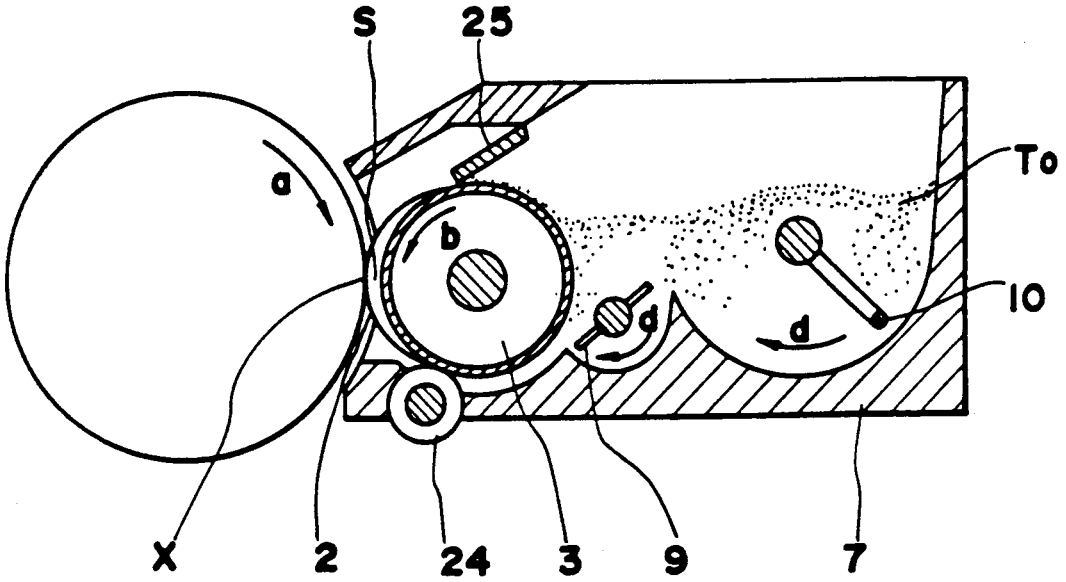
FIGS. 8(*a*) and (*b*) are cross-sectional views of a developing device as the other example of the second embodiment.
Figure 8B:
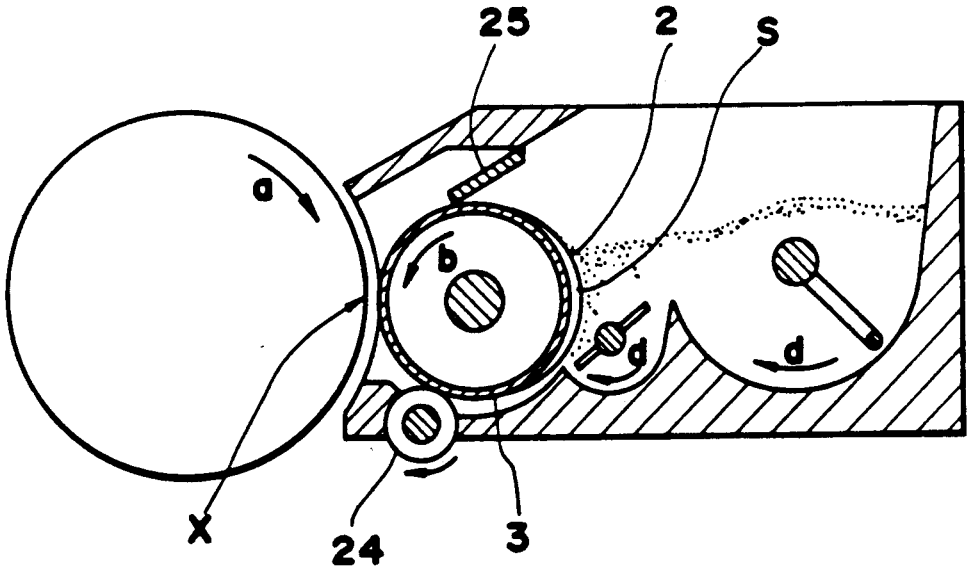

FIG. 8 (*a*) is a cross-sectional view of a developing roller as still another example of the second embodiment of the present invention. In FIG. 8 (*a*), a pressing roller 24 is arranged at the downstream side from the developing region X with respect to the direction of the rotation of the developing roller 3 so as to press contact with the film member 2. Similarly a regulating blade 25 presses contact with the film member 2. Therefore, as shown in FIG. 8 (*a*), during the development, the pressing roller 24 is caused to stop its own rotation by the similar stopper (not shown) to the one shown in the above-mentioned FIG. 1 (*d*). The pressing roller 24 at rest rubs the film member 2 to form the slack of the film member 2 at the side confronting the photoreceptor, resulting in that the space S is formed between the film member 2 and the developing roller 3 so as to keep contact between the film member 2 and the photoreceptor.

While, during the undevelopment, the pressing roller 24 rotates freely to form the slack of the film member at the side opposite to the side confronting the photoreceptor as shown in FIG. 8 (*b*), so that the contact between the photoreceptor 100 and the film member is released.

It is to be noted here that the regulating blade 25 is similar in materials to the regulating blade 5 arranged in the developing device of the first embodiment.

Figure 9:
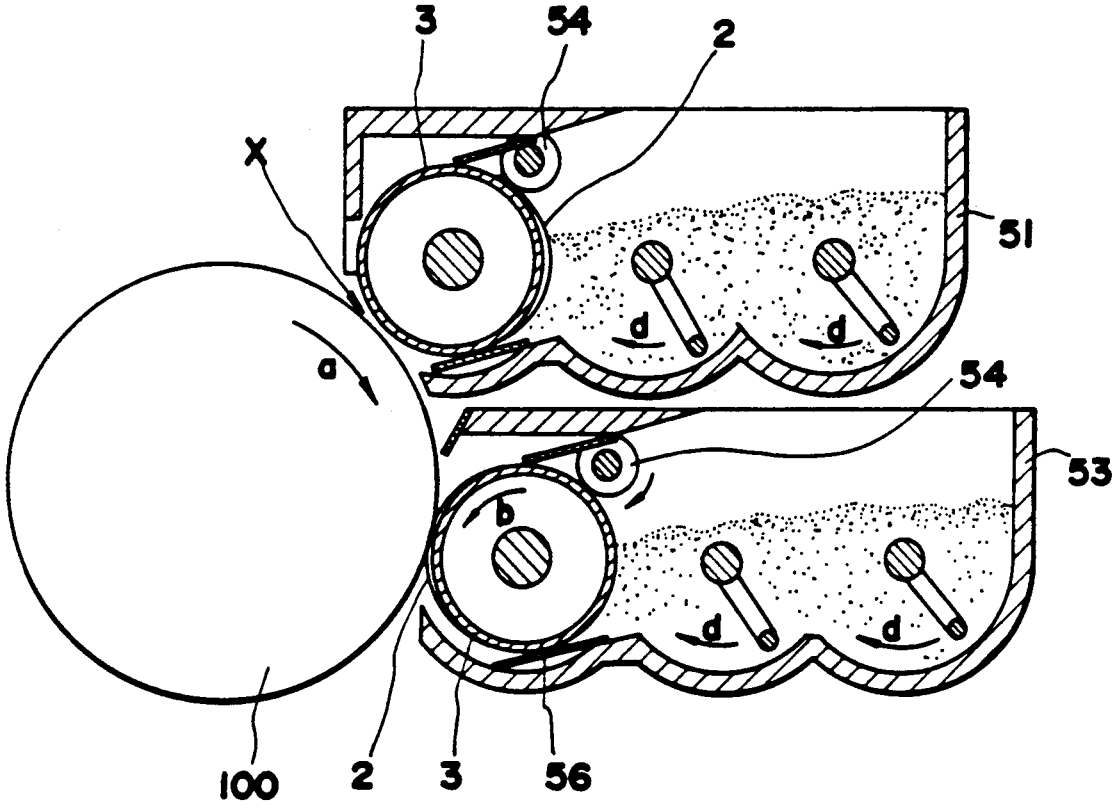
FIG. 9 is a cross-sectional view of two developing devices of the second embodiment disposed around a photoreceptor.

FIG. 9 is a cross-sectional view of two developing devices of the second embodiment according to the present invention disposed around the photoreceptor. In FIG. 9, when a developing device 51 is at rest, a regulating roller 54 stops following its rotation in the direction as shown by the arrow (b). As a result, the slack of the film member is formed at the opposite side to the developing region X so as to prevent the film member 2 from contacting with the photoreceptor 100. On the other hand, when a second developing device 53 is in operation, the regulating roller 54 rotates in the direction opposite to the direction as shown by the arrow (b). Subsequently, the pressure to the film member 2 by the regulating roller 54 and the cleaning blade 56 forms the slack of the film member 2 at the side confronting the photoreceptor of the developing roller 3 in order to bring the film member 2 into contact with the photoreceptor. As a result, the developing operation is performed.

Figure 10A:
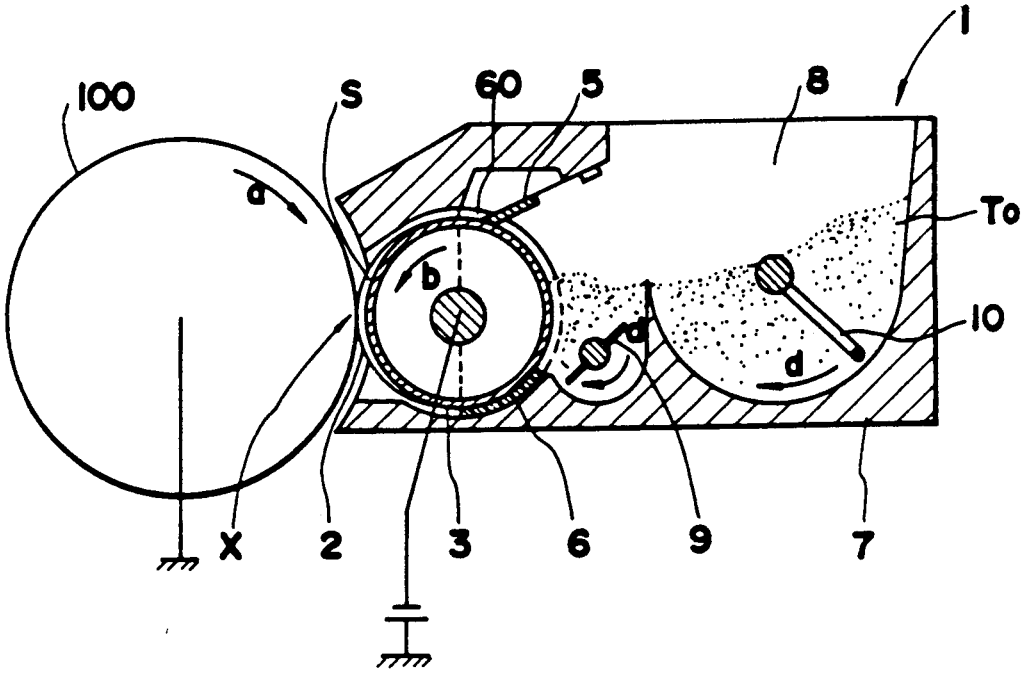
FIGS. 10(*a*) and (*b*) are cross-sectional views of a developing device as one example of a third embodiment of the present invention.
Figure 10B:
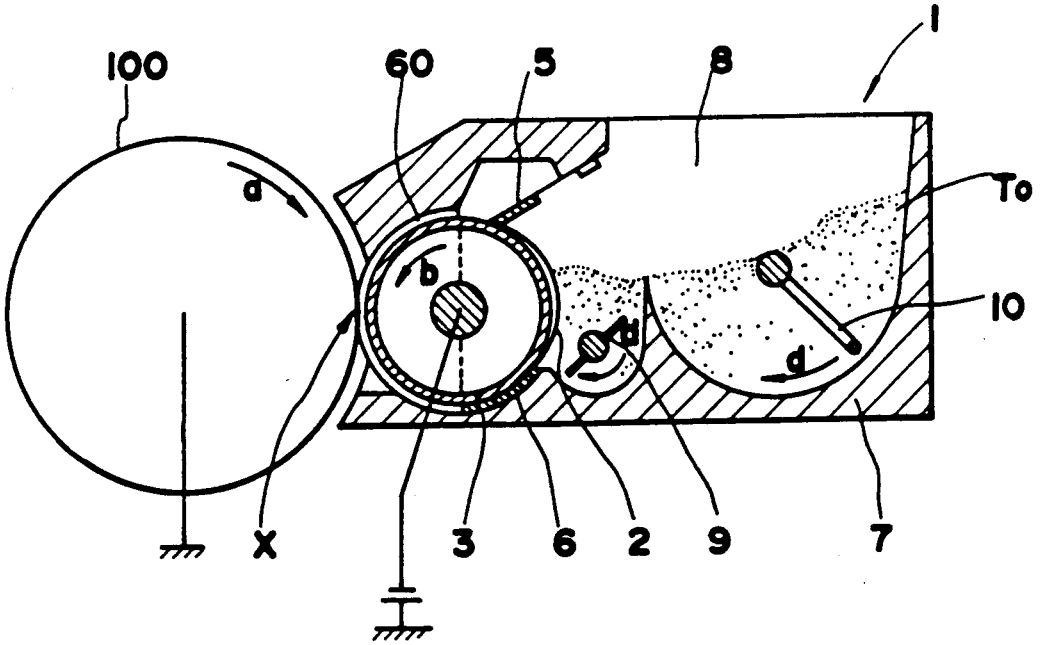
Figure 11A:
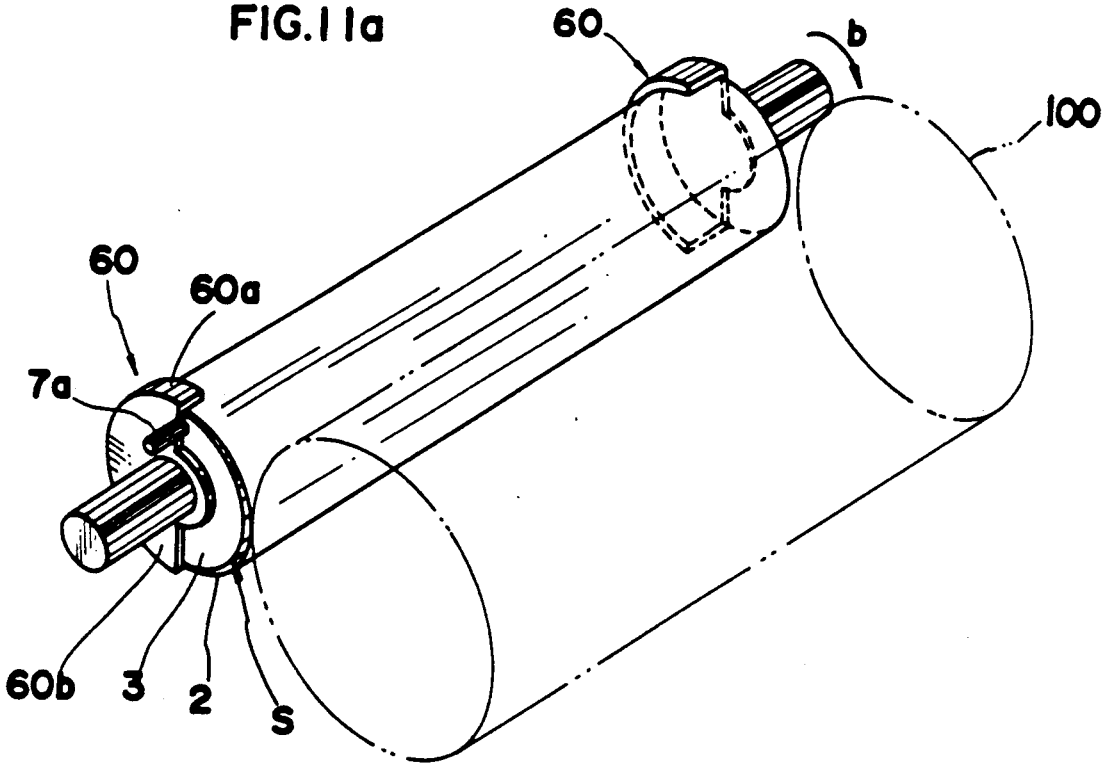
FIG. 11(*a*) is a perspective view showing the position of a guide member in said developing device during the development.
Figure 11B:
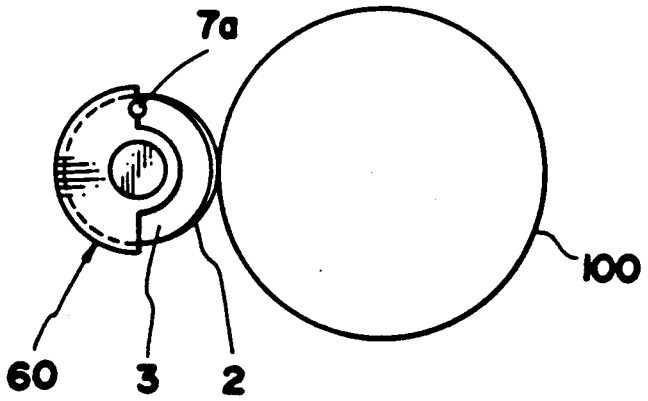

FIGS. 10 (*a*) and (*b*) are cross-sectional views of a developing device of a third embodiment of the present invention, FIG. 11 (*a*) is a perspective view showing the position of guide members in said developing device during the development. FIG. 11 (*b*) is a side view of said guide members during the development. The developing device of the third embodiment is similar in construction to the one of the second embodiment, except for the developing roller. Each end of the developing roller 3 is provided with a guide member 60 which can rotate having its own axis jointly with said developing roller 3.

Said guide members 60 consist of pressing portions 60*a* for pressing substantially half periphery of the film member 2 arranged around the developing roller and support plates 60*b* for supporting said pressing portions so as to turn round on the axis of the developing roller. The internal shape of the pressing portions 60*a* in the guide members 60 fits the external shape of the developing roller. It is to be noted here that the internal shape of the pressing portions 60*a* necessitates substantially fitting the external shape of the developing roller. Consequently, the shape of the pressing portions is not restricted to the one as shown in FIG. 11 (*a*).

Moreover, the internal shape of the pressing portions 60*a* necessitates being sticking elastic compound sheets of foamed polyurethane sheets and polyester sheets or the like for the purpose of causing to adhere the film member to the developing roller. Further, the internal shape of the pressing portions 60*a* may be sticked a tape of fluorine, for example, Teflon (trade mark) or the like so that film member can smoothly slip at the portion where the guide members 60 adhere the film member.

Figure 13:
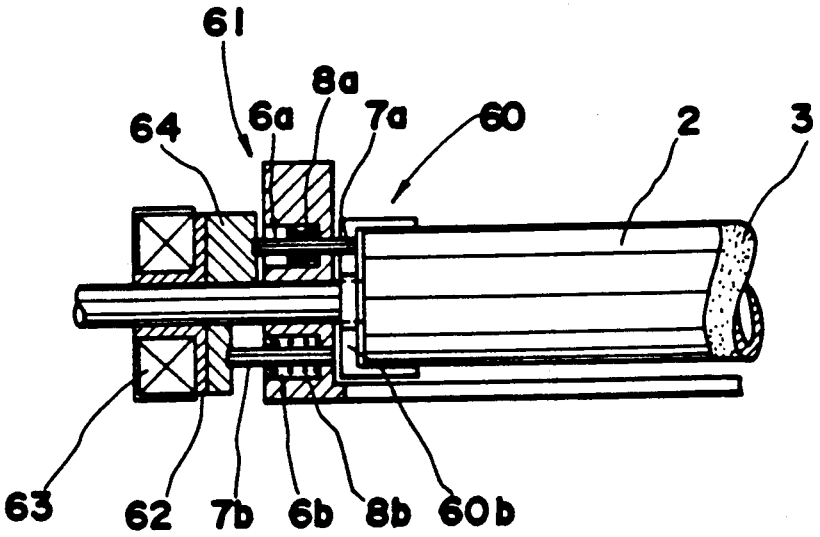
FIG. 13 a cross-sectional view denoting the neighborhood of the guide member in the developing device.

As shown in FIG. 13, the outside of each of said guide members 60 is provided with a side plate 61 which can turn round on the axis of the developing roller 3. Each of the side plates 61 has two concavities which are parallel to the axis of the developing roller 3; 6*a* and 6*b* as well as two pins 7*a* and 7*b* as a stopper for piercing the side plate 61 through said two concavities. Said pins 7*a* and 7*b* are urged outward (in the left direction in FIG. 13) by springs accommodated within the above-mentioned concavities; 8*a* and 8*b*.

Figure 14:
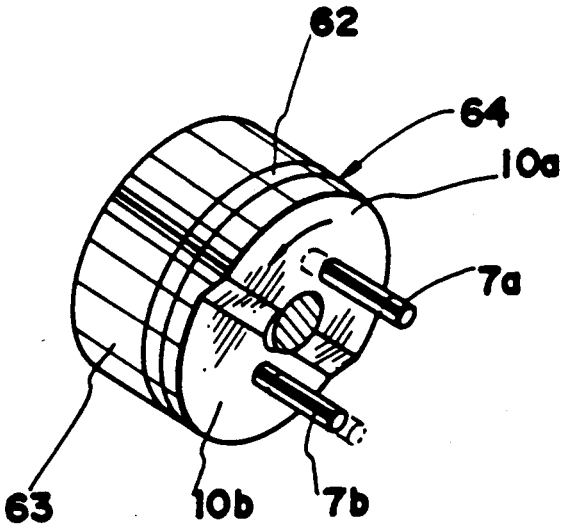
FIG. 14 is a perspective view denoting a cam plate in the developing device.

The outside of each side plate 61 is provided with a cam plate 64 which can turn round on the axis of the developing roller, so that the movement of the pins 7*a*, 7*b* is controlled by them. In other words, as shown in FIG. 14, the inside of said cam plate 64 (the side confronting the developing roller) consists of a convex cam surface 10*a* pushing the pin 7*a* or 7*b* toward the guide member 60 using the spring 8*a* or 8*b* and a concave cam surface 10*b* *retrieving the pin* 7*a* or 7*b* using the spring 8*a* or 8*b*. *Further, the inside of said cam plate* 64 *contacts with the end of the support plate* 60*b* of the guide member through the pins on purpose to stop the rotation of the guide member 60. At the outside of said each of cam plate 64, a clutch 62 and an electromagnetic coil 63 which absorbs and drives said clutch plate 62 are disposed around the axis of the developing roller. Said electromagnetic coil absorbs the clutch plate 62, so that the cam plate 61 rotates.

In a casing 7, a toner storing compartment 8 is arranged. Arranged in said toner storing compartment 8 are the toner supply blade 9 and the agitator 10 which respectively rotate in the direction as shown by the arrow (d) in order to transport the toner while preventing the accommodated toner To from solidifying.

As shown in FIG. 11 (*a*), the film member 2 is caused to adhere around the developing roller 3 by the pressing portion 60*a*, resulting in that the slack of the film member 2 concentrates at an opening portion of the guide member provided at the side confronting the photoreceptor drum so as to form the space S. Through this process, the film member 2 contacts with the photoreceptor 100.

It is to be noted here that the developing roller 3, the film member 2, and the regulating blade 5 or the cleaning blade 6 are selected to satisfy the relationship of $\mu_1 >> \mu_2$, wherein the coefficient of the friction between the external surface of the developing roller 3 and the internal surface of the film member 2 is $\mu_1$, that between the external surface of the film member 2 and the regulating blade 5 or the cleaning blade 6 is $\mu_2$. Accordingly, in synchronism with the rotation of the developing roller 3 in the direction as shown by the arrow (b), the film member 2 also rotates in the same direction.

The developing roller, the film member, the regulating blade and the toner used in the developing device of the third embodiment are similar in materials to the ones used in the developing device of the first embodiment.

The operation of the developing device 1 having the above described construction will be explained hereinafter.

During the development, as shown in FIG. 10 (*a*), FIG. 11 (*a*) and (*b*), on condition that the upper pin 7*a* pushing toward the developing roller fixes the end of the support plate 60*b* of the guide member 60 trying to rotate with the developing roller 3 in the direction as shown by the arrow (b), the operation is carried out. Therefore, as shown in FIG. 10 (*a*), the developing roller 3, the supply blade 9, and the agitator 10 are caused to rotate by a driving means 30 respectively in directions as shown by the arrows (b) and (d), resulting in that the toner To accommodated within the toner storing compartment 8 is forcibly moved in a direction shown by the arrow (d) under an effect of stirring by the supply blade 9 and the agitator 10.

Meanwhile, the film member 2 is driven to rotate in the direction as shown by the arrow (b) under the influence of frictional force exerting between it and the developing roller 3.

The toner To accommodated within the toner storing compartment 8, which is in contact with the film member 2, is caused to adhere to the surface of the film member 2 by the action of electrostatic force, and then, is transported in the direction as shown by the arrow (b). When the toner To held on the surface of the film member 2 reaches the portion pressed by the regulating blade 5 on the surface of the developing roller 3, the toner To is applied uniformly in the form of a thin layer on the surface of the film member 2 and charged through the friction therewith.

The thin layer of the toner held on the surface of the film member 2 under the influence of its own electrostatic force, which forms a toner image to be developed through the similar process to the first embodiment.

Since the film member 2 in contact with the photoreceptor drum 100 is never brought into contact with the developing roller due to the existence of the space S, the film member 2 softly and uniformly contacts with the photoreceptor drum 100 through its suitable nip width so that the latent image formed on the photoreceptor drum 100 may be turned to the uniform toner image. In the case where a peripheral speed of the photreceptor drum 100 is caused to differ from that of the film member 2, the toner image once formed on the photoreceptor drum 100 can never be broken by physical force such as rubbing force or the like. In particular, in the case where the peripheral speed of the film member 2 is set faster than that of the photoreceptor drum 100, the density of an image can be increased, so that a fog can be effectively prevented in a non-image portion.

The toner To having passed the developing region X is successively transported, together with the film member 2, in the direction as shown by the arrow (b). When the toner To passes between the cleaning blade 6 and the film member 2, an image pattern from which the toner To has already been consumed in the developing region X is erased so that the uniformity of the toner layer may be obtained.

Subsequently, the toner is supplied again on the surface of the film member 2 by the rotation of the toner supply 9, and then the aforementioned operation is repeated thereafter.

Figure 12A:
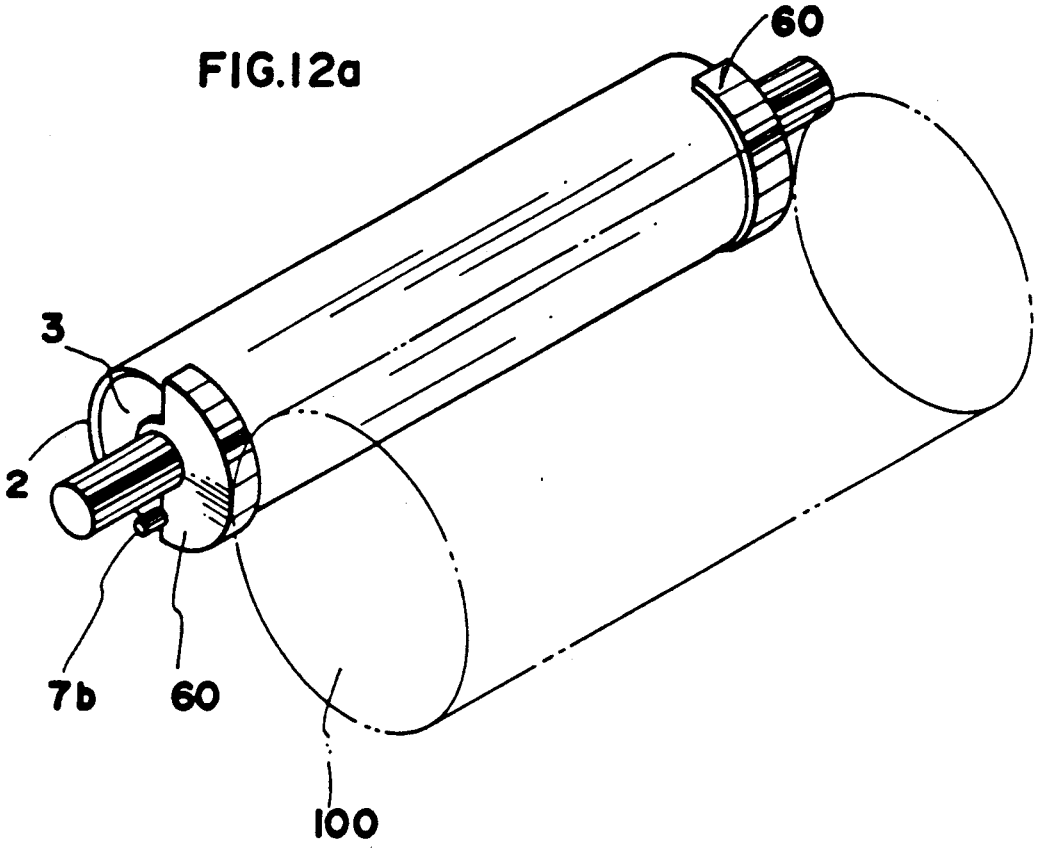
FIG. 12(*a*) is a perspective view showing the position of the guide member in the developing device during the undevelopment.
Figure 12B:
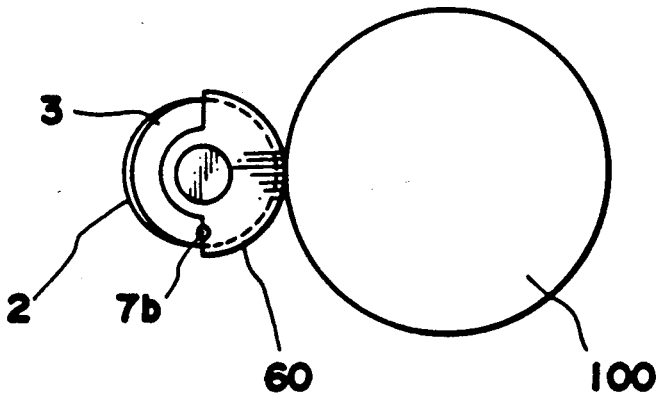

On the other hand, in the case where the development by the developing device 1 is not carried out, as shown in FIG. 10(*b*) and FIGS. 12 (*a*) and (*b*), the upper pin 7*a* is receded by the rotation of the above-mentioned cam plate 64, and at the same time, the lower pin 7*b* advances toward the developing roller. Moreover, after a predetermined time has passed, the driving of the developing roller is stopped. As a result, the guide member rotates for substantially half rotation in order to be located at the side confronting the photoreceptor 100, so that the slack of the film member 2 is formed at the opposite side of the developing roller to the side confronting the photoreceptor. Through this process, the contact between the film member 2 and the photoreceptor 100 is released.

Figure 15:
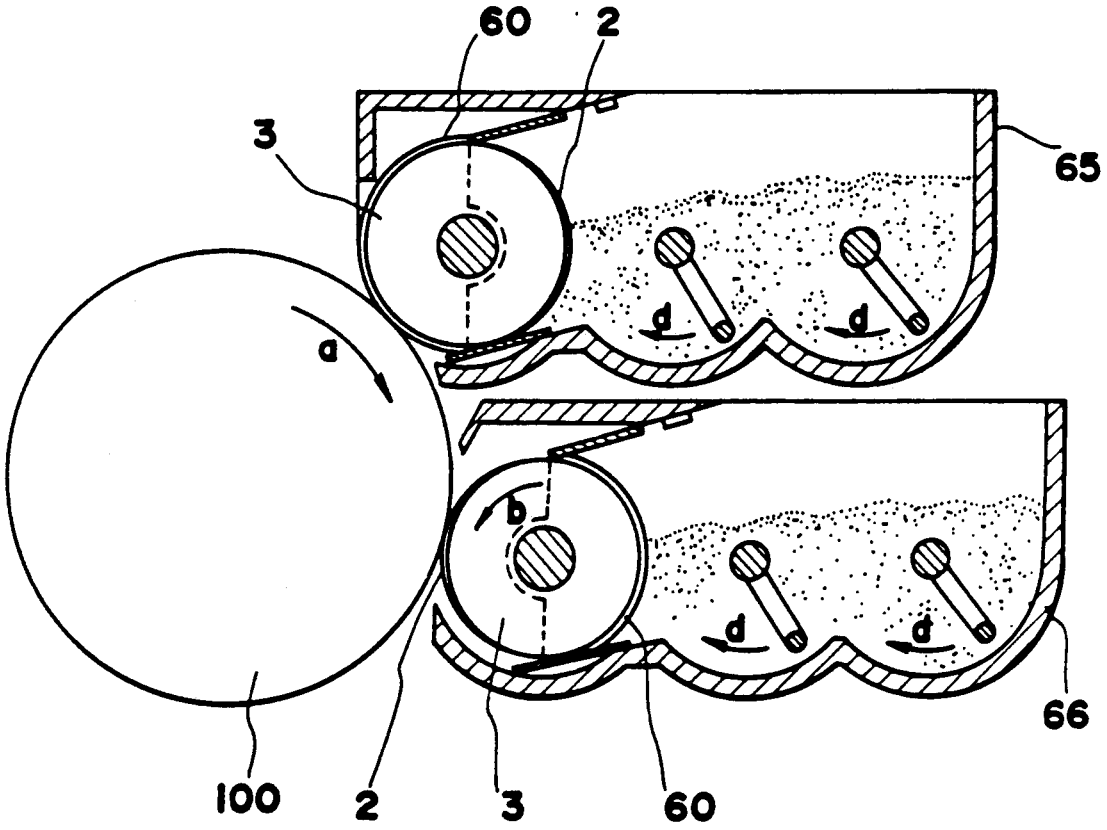
FIG. 15 is a cross-sectional view of two developing devices of the third embodiment disposed around a photoreceptor.

FIG. 15 is a cross-sectional view of two developing devices of the third embodiment disposed around the photoreceptor. In FIG. 15, when the developing device 65 is at rest, the upper pins are receded, and at the same time, the lower pins 7*b* advances. Therefore, each of the guide members is located at the side controlling the photoreceptor in order to release the contact between the film member 2 and the photoreceptor 100. Meanwhile, when a second developing device 66 is in operation, the upper pin 7*a* advances and the lower pin 7*b* are receded. As a result, the guide member 60 is fixed at the position opposite to the first developing device 65 in order to form the slack of the film member 2 at the side confronting the photoreceptor of the developing roller. Subsequently, the film member 2 contacts with the photoreceptor 100 to carry out the development.

Figure 16A:
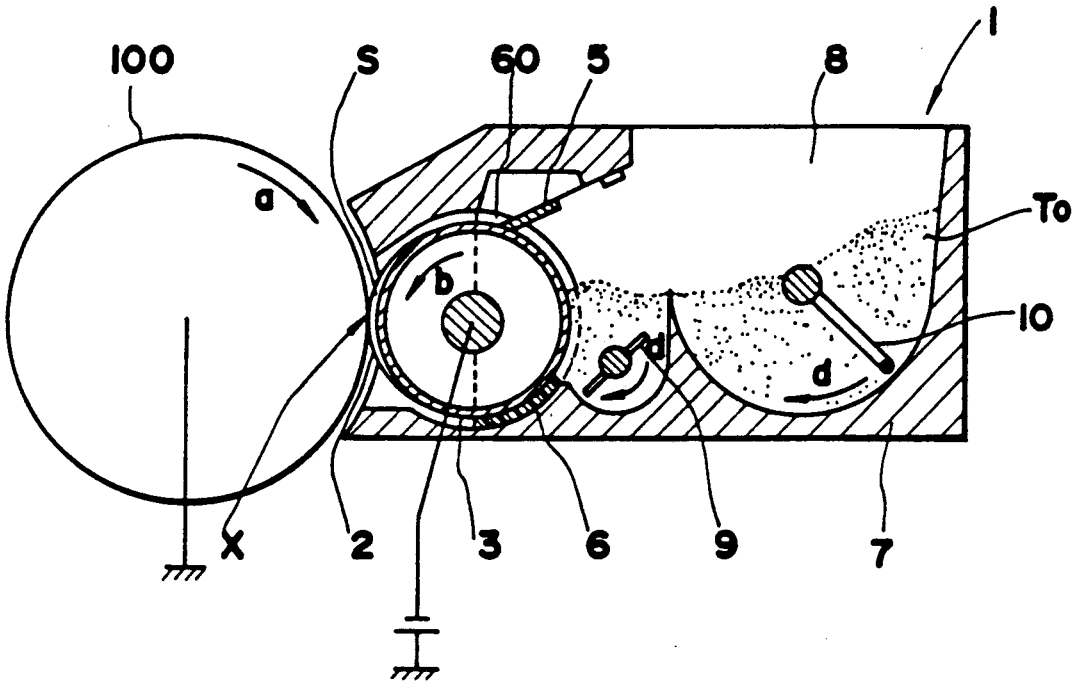
FIGS. 16(*a*) and (*b*) are cross-sectional views of a developing device as one example of a fourth embodiment of the present invention.
Figure 16B:
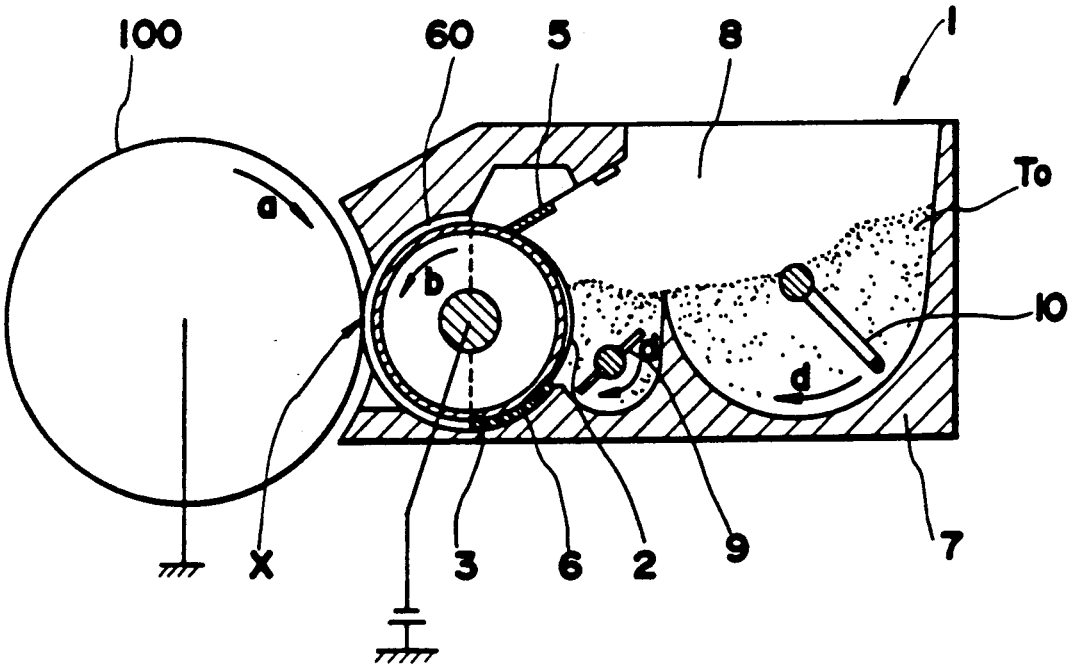
Figure 17A:
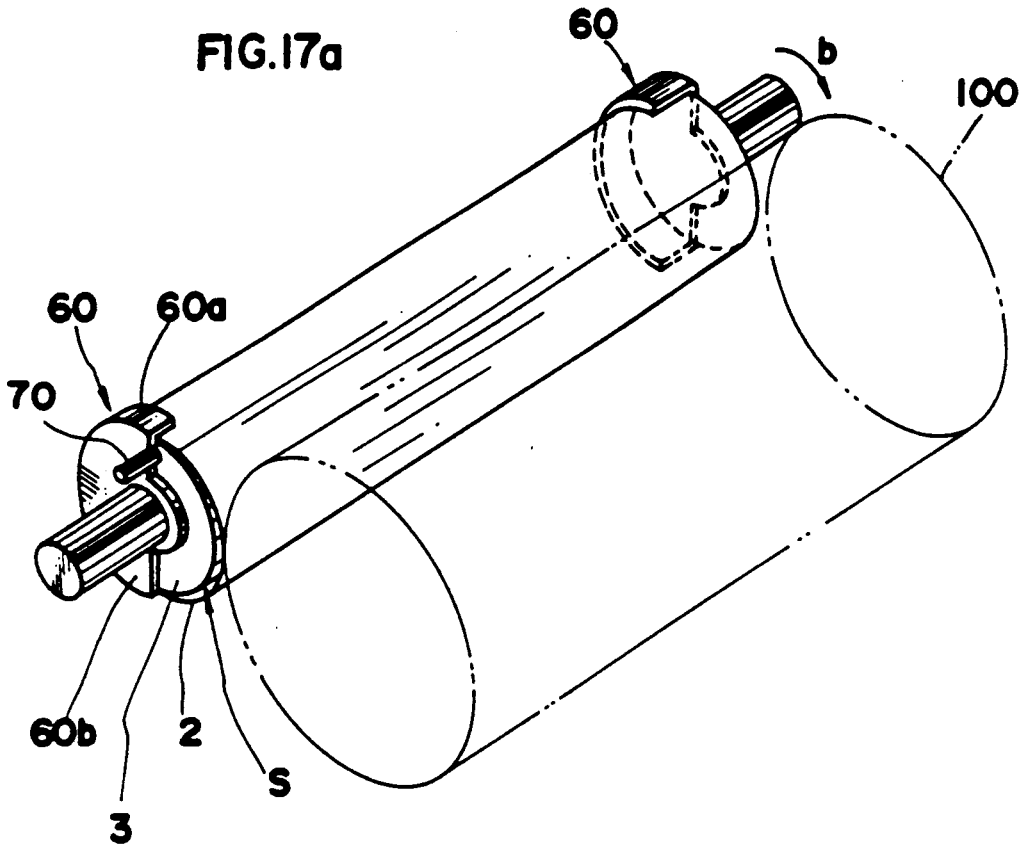
FIG. 17(*a*) is a perspective view showing the position of a guide member in said developing device during the development.
Figure 17B:
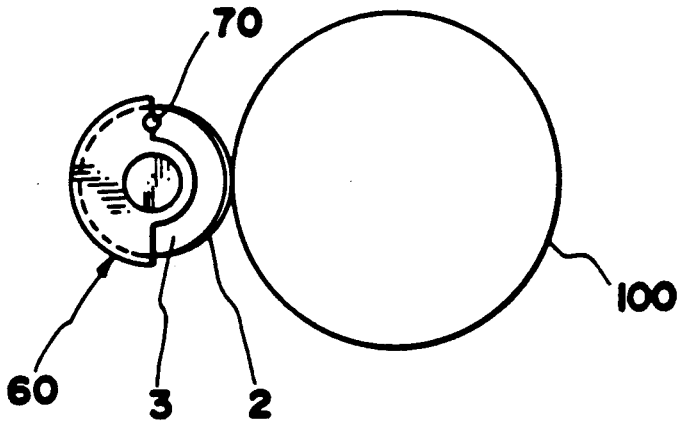

FIG. 16 is a cross-sectional view of a developing device 1 of a fourth embodiment according to the present invention. FIG. 17 (*a*) and FIG. 18 (*a*) are perspective views showing the main parts of the developing device 1. The developing device 1 is generally similar to the one of the third embodiment.

Figure 18A:
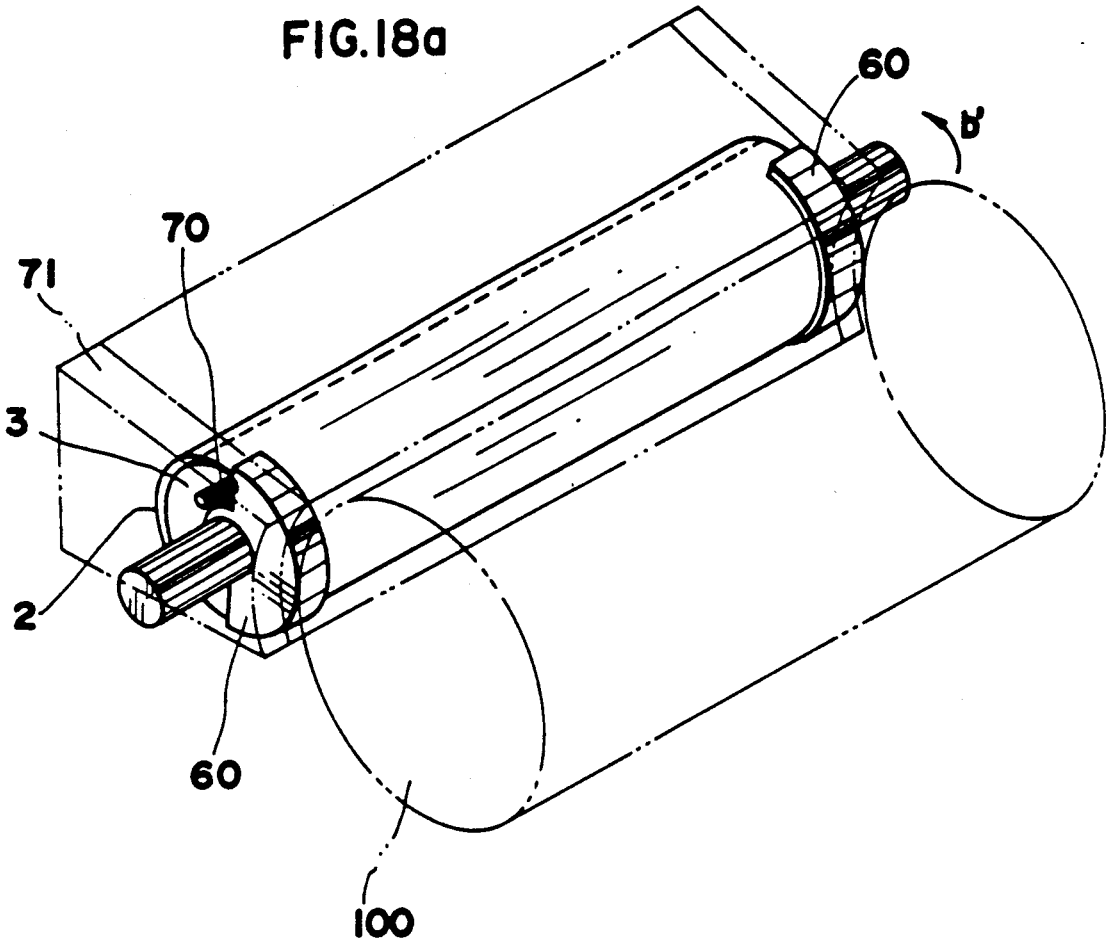
FIG. 18(*a*) is a perspective view denoting the position of the guide member in the developing device during the undevelopment.
Figure 18B:
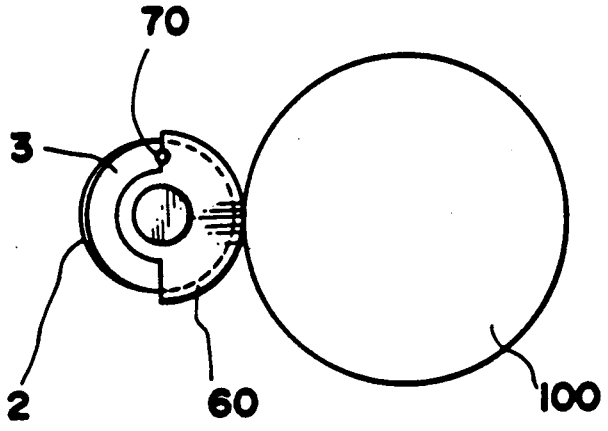

The outside of each guide member 60 is provided with a side plate 71 (shown in FIG. 18 (*a*). Each of side plates 71 has a pin 70 which is a stopper projecting in parallel with the axis of the developing roller 3. Said pin 70 is in contact with the end of the support plate 60*b* of the guide member 60, and the pin 70 stops the rotation of the guide member 60 in the direction as shown by the arrow (b) under the influence of the rotation of the developing roller 3.

In the casing 7, the toner storing compartment 8 is arranged. Arranged in said toner storing compartment 8 are the agitator 9 and 10 which respectively rotate in the direction as shown by the arrow (d). They transport the toner while preventing the accommodated toner from solidifying.

As shown in FIG. 17 (*a*), the film member 2 is caused to adhere around the developing roller 3 by the pressing portion 60*a*, resulting in that the slack of the film member 2 concentrates at the opening portion of the guide member provided at the side confronting the photoreceptor drum. Through this process, the space S is formed between the film member 2 and the developing roller 3, so that the film member 2 contacts with the photoreceptor 100.

It is to be noted here that the developing roller 3, the film member 2, and the regulating blade 5 or the cleaning blade 6 are selected to satisfy the relationship of $\mu_1 >> \mu_2$, wherein the coefficient of the friction between the external surface of the developing roller 3 and the internal surface of the film member 2 is $\mu_1$, that between the external surface of the film member 2 and the regulating blade 5 or the cleaning blade 6 is $\mu_2$. Accordingly, in synchronism with the rotation of the developing roller 3 in the direction of an arrow (b), the film member 2 also rotates in the same direction.

The developing roller, the film member, the regulating blade and the toner used in the developing device of the fourth embodiment are similar in materials to the ones used in the developing device of the first embodiment.

The operation of the developing device 1 having the above described construction will be explained hereinafter.

As shown in FIG. 16 (*a*), and FIGS. 17 (*a*) and (*b*), during the development, the developing roller 3 rotates in the direction as shown by the arrow (b). The pin 70 fixes the end of the support plate 60*b* of the guide member 60 trying to rotate in the direction as shown by the arrow (b) under the influence of the rotation of the developing roller in order to inhibit the rotation of the guide member 60. As a result, the guide member is caused to stop at the opposite side of the developing roller to the side confronting the photoreceptor. Accordingly, as shown in FIG. 16 (*a*), on condition that the developing roller 3, the toner supply 9 and the agitator 10 are caused to rotate by a driving means 30 shown in FIG. 2 (*a*) respectively in directions as shown by the arrows (b) and (d), the toner To accommodated within the toner storing compartment 8 is forcibly moved in a direction shown by the arrow (d) under an effect of stirring by the toner supply 9 and the agitator 10.

Meanwhile, the film member 2 is driven to rotate in the direction as shown by the arrow (b) under the influence of frictional force exerting between it and the developing roller 3. The toner To accommodated within the toner storing compartment 8, which is in contact with the film member 2, is caused to adhere to the surface of the film member 2 by the action of electrostatic force, and then, is transported in the direction as shown by the arrow (b). When the toner To held on the surface of the film member 2 reaches the portion pressed by the regulating blade 5 on the surface of the developing roller 3, the toner To is applied uniformly in the form of a thin layer on the surface of the film member 2 and charged through the friction therewith.

The toner To of thin layer held on the surface of the film member 2 under the influence of its own electrostatic force, which forms a toner image to be developed through the similar process to the first embodiment.

Since the film member 2 in contact with the photoreceptor drum 100 is never brought into contact with the developing roller due to the existence of the space S, the film member 2 softly and uniformly contacts with the photoreceptor drum 100 through its suitable nip width so that the latent image formed on the photoreceptor drum 100 may be turned to the uniform toner image. In the case where a peripheral speed of the photoreceptor drum 100 is caused to differ from that of the film member 2, the toner image once formed on the photoreceptor drum 100 can never be broken by physical force such as rubbing force or the like. In particular, in the case where the peripheral speed of the film member 2 is set faster than that of the photoreceptor drum 100, the density of an image can be increased, so that a fog can be effectively prevented in a non-image portion.

The toner To having passed the developing region X is successively transported, together with the film member 2, in the direction as shown by the arrow (b). When the toner To passes between the cleaning blade 6 and the film member 2, an image pattern from which the toner To has already been consumed in the developing region X is erased so that the uniformity of the toner layer may be obtained.

Subsequently, the toner is supplied again on the surface of the film member 2 by the rotation of the toner supply 9, and then, the aforementioned operation is repeated thereafter.

Meanwhile, in the case where the development by the developing roller 1 is not carried out, as shown in FIG. 16 (*b*) and FIGS. 18 (*a*) and (*b*), the developing roller rotates contrarily (rotates in a direction as shown by an arrow (*b'*) following once stopping its rotation, and then, stops the driving after a predetermined time has passed. Therefore, the guide member 60 rotates for substantially half rotation under the influence of the contrary rotation of the developing roller 3 in order to contact with the above-mentioned pin 70 at the end opposite to the end at which the developing roller contacts with the pin during the development, and stops. In short, the guide member 60 is located at the side confronting the photoreceptor 100, so that the slack of the film member 2 is formed at the opposite side of the developing roller to the side confronting the photoreceptor. Through this process, the contact between the film member 2 and the photoreceptor is released.

Figure 19:
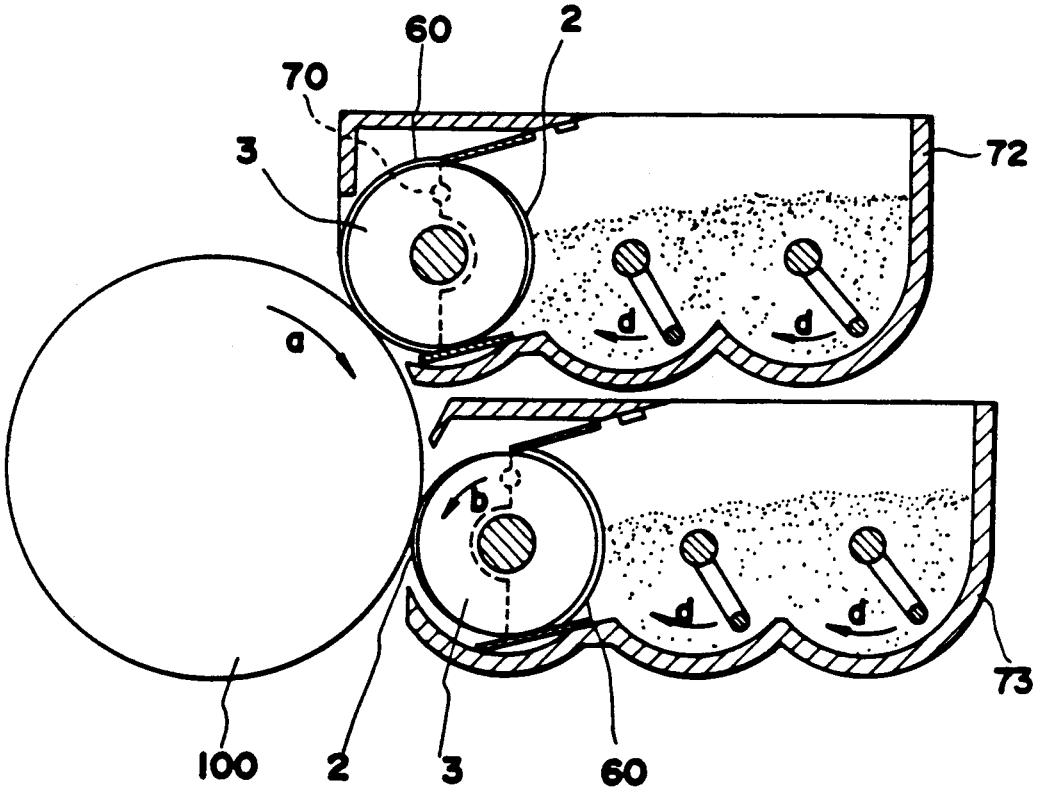
FIG. 19 is a cross-sectional view of two developing devices of the fourth embodiment disposed around a photoreceptor.

FIG. 19 is a cross-sectional view of two developing devices of the fourth embodiment disposed around the photoreceptor. In a first developing device 72, the development is not carried out. Accordingly, the developing roller stops after rotating contrarily, the guide member 60 is located at the side confronting the photoreceptor so as to prevent the film member 2 from contacting with the photoreceptor 100. On the other hand, in a second developing device 73, the developing roller rotates in the direction as shown by the arrow (b). The pin inhibits the rotation of the guide member 60 trying to rotate in the direction as shown by the arrow (b), and the guide member 60 is located in the position opposite to said first developing device. As a result, the slack of the film member 2 is formed at the side of the developing roller 3 confronting the photoreceptor, the film member 2 contacts with the photoreceptor 100 to perform developing operation.

As clearly described so far, in the developing device according to the present invention, the film member having a peripheral length longer than that of the developing roller is loosely mounted around the developing roller and, a slack is formed between the film member and the developing roller at a location confronting the photoreceptor. By such an arrangement, the slack of the film member is brought into light contact with the surface of the photoreceptor so that the toner held on the surface of the film member may be supplied onto the electrostatic latent image formed on the surface of the photoreceptor.

Accordingly, the surface of the photoreceptor is prevented from being damaged. Furthermore, even when a gap is unevenly formed between the developing roller and the photoreceptor member due to respective warp, twist or the like, such unevenness is absorbed by the slack portion of the film member, thus resulting in that the gap between the developing roller and the photoreceptor can be readily adjusted. Moreover, since the toner layer formed on the film member is kept in light contact with the photoreceptor through its sufficient nip width, the toner image formed on the photoreceptor never be broken, even if a peripheral speed thereof differs from that of the developing roller. Consequently, picture quality can be prevented from lowering and, a printed image having steady uniform density can be obtained.

In addition, in a toner supply portion where the toner is applied on the surface of the film member, since the film member is kept in close contact with the developing roller, a thin layer forming member can be brought into steady contact with the film member, even when a regulating blade is used as the thin layer forming member. Accordingly, in the toner supply portion, since the regulating blade can be pressed against the film member under sufficient pressure, electrostatic potential of the charged toner can be raised up to a desirable value, thereby enabling the thin layer of the toner to be formed uniformly.

On the other hand, the developing device of the present invention enables the film member to move smoothly from the side confronting the photoreceptor to the opposite side by controlling the aforementioned means for adhering the film member. Therefore, the operation of the contact and the non-contact between the developing roller and the photoreceptor can be carried out easily without moving the whole developing device. Consequently, the developing device of the present invention facilitates the change of a developing device while preventing toner colours from mixing, resulting in that multi-colored development can be carried out easily. Furthermore, it facilitates the exchange of the toner color and the maintenance of an apparatus which makes single-colored development.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device for developing an electrostatic latent image formed on a photoreceptor, comprising:

a cylindrical formed flexible member;

means for pressing said flexible member into contact with a surface portion of the photoreceptor using a magnetic force;

means for rotating said flexible member; and means for providing toner to a surface of said flexible member.

2. A developing device as claimed in claim 1 wherein said flexible member includes a magnetic substance and said pressing means includes a magnet.

3. A developing device for developing an electrostatic latent image formed on a photoreceptor, comprising:

a cylindrically formed flexible member, said flexible member including a magnetic substance;

rotating means for rotating said flexible member which includes a roller member rotatably disposed and confronting the photoreceptor, said roller member having an external peripheral length shorter than an internal peripheral length of said flexible member so as to loosely support said flexible member;

magnetic pressing means provided inside of said roller means for pressing said flexible member into contact with a surface of the photoreceptor; and forming means for forming a toner layer on an external surface of said flexible member.

4. A developing device as claimed in claim 3 wherein said magnetic means includes a magnet which has a plurality of poles along a surface of said roller member.

5. A developing device as claimed in claim 3 wherein said magnetic means includes a substantially semicircular shaped magnet.

6. A developing device as claimed in claim 3 wherein said magnetic means includes an electro-magnet.

7. A developing device as claimed in claim 3 wherein a toner forming said toner layer is a magnetic toner.

8. A developing device as claimed in claim 3 wherein said flexible member is a metallic thin film.

9. A developing device as claimed in claim 3 wherein said roller member is formed of aluminum whose surface has minute concave and convex portions, conductive rubber of conductive plastic.

10. A developing device as claimed in claim 3, wherein said flexible member is a thin resinous film having fine metallic particles therein.

11. In a developing device disposed adjacent to a rotatably arranged photoreceptor for developing an electrostatic latent image formed on the photoreceptor, a method comprising the steps of:

providing a cylindrically formed flexible member;

pressing said flexible member, by means of a magnetic force, into contact with a surface of the photoreceptor;

rotating said flexible member; and providing toner to a surface of said flexible member, said provided toner being transported to a location confronting the photoreceptor to develop the electrostatic latent image.

12. A method for developing as claimed in claim 11 wherein said flexible member includes a magnetic substance.

13. A developing device for developing an electrostatic latent image formed on a photoreceptor, comprising:

a cylindrical flexible member;

means for rotating said flexible member;

means for providing toner to a surface of said flexible member; and magnetic urging means for magnetically urging said flexible member surface into contact with the photoreceptor to thereby provide said toner to the photoreceptor to develop the electrostatic latent image.

* * * * *